US010861660B2

(12) United States Patent
Watanabe et al.

(10) Patent No.: US 10,861,660 B2
(45) Date of Patent: Dec. 8, 2020

(54) SAFETY SWITCH

(71) Applicant: IDEC CORPORATION, Osaka (JP)

(72) Inventors: Tatsuhiro Watanabe, Osaka (JP); Masatake Yamano, Osaka (JP)

(73) Assignee: IDEC CORPORATION

( * ) Notice: Subject to any disclaimer, the term of this patent is extended or adjusted under 35 U.S.C. 154(b) by 0 days.

(21) Appl. No.: 16/484,675

(22) PCT Filed: Feb. 16, 2018

(86) PCT No.: PCT/JP2018/005478
§ 371 (c)(1),
(2) Date: Aug. 8, 2019

(87) PCT Pub. No.: WO2015/155335
PCT Pub. Date: Aug. 30, 2018

(65) Prior Publication Data

US 2020/0058457 A1 Feb. 20, 2020

(30) Foreign Application Priority Data

Feb. 24, 2017 (JP) ..... 2017-032762

(51) Int. Cl.
*H01H 27/00* (2006.01)

(52) U.S. Cl.
CPC ..... *H01H 27/002* (2013.01); *H01H 2027/005* (2013.01)

(58) Field of Classification Search
CPC ..... H01H 27/002; H01H 2027/005
(Continued)

(56) References Cited

U.S. PATENT DOCUMENTS 5,464,954 A * 11/1995 Kimura ..... H01H 27/007 200/61.62
5,760,353 A 6/1998 Rapp ..... 200/17 R
(Continued)

FOREIGN PATENT DOCUMENTS

CN 1165387 A 11/1997
DE 100 41 129 C1 12/2001
(Continued)

OTHER PUBLICATIONS

PCT/IB/326 Notification Concerning Transmittal of International Preliminary Report on Patentability including PCT/IB/373 and PCT/ISA/237 (in Japanese) dated Sep. 6, 2019 for International Application No. PCT/JP2018/005478.
(Continued)

*Primary Examiner* — William A Bolton
*Assistant Examiner* — Iman Malakooti
(74) *Attorney, Agent, or Firm* — Ostrolenk Faber LLP

(57) ABSTRACT

A cam of a safety switch rotates about a rotational shaft in accordance with an operation of inserting an actuator into an opening and an operation of withdrawing the actuator. A switch part includes an operation rod that reciprocates according to a rotation angle of the cam, and detects an insertion state where the actuator is inserted in the opening. In the insertion state, a locking member locks the actuator upon engagement with a part of the cam. When the operation of withdrawing the actuator is performed in a locked state of the actuator, the cam pushes the locking member in one direction, and the locking member pushes a part of a head case in the one direction. This improves locking strength of the safety switch.

14 Claims, 20 Drawing Sheets

(58) Field of Classification Search
USPC ..... 200/43.04
See application file for complete search history.

(56) References Cited

U.S. PATENT DOCUMENTS

| | | | | |
|---|---|---|---|---|
| 5,898,143 | A | 4/1999 | Da Dalt | 200/17 |
| 5,929,404 | A | 7/1999 | Wecke et al. | 200/43.11 |
| 5,959,270 | A * | 9/1999 | Wecke | H01H 27/002 200/17 R |
| 6,118,087 | A | 9/2000 | Fukui | 200/43.04 |
| 7,999,200 | B2 * | 8/2011 | Komori | H01H 3/161 200/324 |
| 8,228,146 | B2 * | 7/2012 | Bachle | E05B 47/0002 200/334 |

FOREIGN PATENT DOCUMENTS

| | | | | |
|---|---|---|---|---|
| DE | 10041129 | * | 12/2001 | H01H 27/00 |
| JP | H06-076675 | A | 3/1994 | |
| JP | H07-122152 | A | 5/1995 | |
| JP | H07-127795 | A | 5/1995 | |
| JP | H09-502298 | A | 3/1997 | |
| JP | H10-302580 | A | 11/1998 | |
| JP | 2004-079204 | A | 3/2004 | |
| JP | 2007-257973 | A | 10/2007 | |
| JP | 2009-016214 | A | 1/2009 | |
| JP | 2013-033614 | A | 2/2013 | |

OTHER PUBLICATIONS

PCT/IB/338 Notification of Transmittal of Translation of the International Preliminary Report on Patentability including PCT/IB/373 and PCT/ISA/237 (in English) dated Sep. 6, 2019 for International Application No. PCT/JP2018/005478.

International Search Report dated May 15, 2018 in corresponding PCT International Application No. PCT/JP2018/005478.

Written Opinion dated May 15, 2018 in corresponding PCT International Application No. PCT/JP2018/005478.

Office Action dated Oct. 10, 2020 issued in corresponding Chinese Patent Application No. 2018800126082 with machine translation.

* cited by examiner

SAFETY SWITCH

CROSS-REFERENCE TO RELATED APPLICATIONS

The present application is a 35 U.S.C. §§ 371 national phase conversion of PCT/JP2018/005478, filed Feb. 16, 2018, which claims priority to Japanese Patent Application No. 2017-032762, filed Feb. 24, 2017, the contents of both of which are incorporated herein by reference. The PCT International Application was published in the Japanese language.

TECHNICAL FIELD

The present invention relates to a safety switch.

BACKGROUND ART

Safety switches have conventionally been provided at entrances of rooms where industrial equipment or other equipment is located. For example, a safety switch is mounted on a wall surface near an entrance, and an actuator for the safety switch is mounted on a door to the entrance. When the entrance door is closed, the actuator is inserted into an opening of the safety switch, which enables power supply to the industrial equipment or other equipment. When the entrance door is opened, the actuator is withdrawn from the opening, which disables power supply to the industrial equipment or other equipment.

Safety switches that are capable of locking actuators are used as well. For example, the safety switch disclosed in Japanese Translation of PCT Application No. H9-502298 (Document 1) locks an actuator by bringing a plunger into engagement with a stopping notch provided in a cam.

In the safety switch according to Patent Document 1, if an operation of withdrawing the actuator is performed in a locked state, the withdrawal of the actuator with a relatively small force can damage the plunger and unlock the actuator. There is thus demand for the ability to improve locking strength of the safety switch. For a safety switch that includes a locking member for locking an actuator, there is also demand for the ability to improve reliability of operations of the locking member.

SUMMARY OF INVENTION

The present invention is intended for a safety switch, and it is an object of the present invention to improve the locking strength of the safety switch and to improve the reliability of operations of a locking member that locks an actuator.

A safety switch according to the present invention includes a case having an opening in which an actuator is insertable, a cam disposed in the case and that rotates about a rotational shaft upon engagement with a part of the actuator in accordance with an insertion operation of inserting the actuator into the opening and a withdrawal operation of withdrawing the actuator, a switch part that includes a rod and detects an insertion state where the actuator is inserted in the opening, the rod reciprocating according to a rotation angle of the cam, a locking member that locks the actuator upon engagement with a part of the cam in the insertion state, and an unlocking part that unlocks the actuator locked by the locking member. In a case where the withdrawal operation of withdrawing the actuator is performed in a locked state where the actuator is locked, the cam pushes the locking member in one direction, and the locking member pushes a part of the case either directly or indirectly in the one direction. This configuration improves the locking strength of the safety switch.

In a preferable embodiment of the present invention, in the locked state, a face of the locking member on a side close to the part of the cam overlaps at least partly with a face of the locking member on a side close to the part of the case, when viewed in the one direction.

In another preferable embodiment of the present invention, the part of the case is perpendicular to the one direction, and a face of the locking member that is perpendicular to the one direction comes in contact with the part of the case when the withdrawal operation is performed in the locked state.

In yet another preferable embodiment of the present invention, the locking member is supported by the case to be rotatable about an axial part that is parallel to the rotational shaft, and when the withdrawal operation is performed in the locked state, a force acting on the axial part is smaller than a force acting on a face of the locking member on a side close to the part of the case.

In one aspect of the present invention, the locking member includes a coupling part that is coupled to and moves with the rod, and the unlocking part unlocks the actuator upon movement of the rod that is independent of rotation of the cam.

Another safety switch according to the present invention includes a case having an opening in which an actuator is insertable, a cam disposed in the case and that rotates about a rotational shaft upon engagement with a part of the actuator in accordance with an insertion operation of inserting the actuator into the opening and a withdrawal operation of withdrawing the actuator, a switch part that includes a rod and detects an insertion state where the actuator is inserted in the opening, the rod reciprocating according to a rotation angle of the cam, a locking member that locks the actuator upon engagement with a part of the cam in the insertion state, and an unlocking part that unlocks the actuator locked by the locking member. The locking member includes a coupling part that is coupled to and moves with the rod, and the unlocking part unlocks the actuator upon movement of the rod that is independent of rotation of the cam. This configuration improves reliability of operations of the locking member.

In the safety switch in which the locking member includes the coupling part, preferably, the switch part biases the rod toward the cam, and in the insertion state, the locking member that is engaged with the part of the cam retains the rod at a predetermined position spaced from the cam. More preferably, the locking member includes a weakened part, and in a case where the weakened part is broken by the withdrawal operation of withdrawing the actuator in a locked state where the actuator is locked, at a next time when the insertion state is formed, the rod is disposed at a position closer to the cam than the predetermined position, and the switch part detects the break of the weakened part.

For example, the case includes a head case that houses the cam and the locking member, and a body case in which the switch part is assembled, the coupling part is coupled to the rod while being rotatable about the rod, and when the safety switch is not mounted on a mounting face, the head case is rotatable relative to the body case about the rod. In this case, preferably, the rod has a tip end face that slides over an outer peripheral surface of the cam, and a ring-shaped groove provided at a position that is farther away from the cam than the tip end face, the locking member is supported by the head case to be rotatable about an axial part that is parallel to the rotational shaft, and the coupling part of the locking member has a recess that is engaged with the ring-shaped groove.

These and other objects, features, aspects and advantages of the present invention will become more apparent from the following detailed description of the present invention when taken in conjunction with the accompanying drawings.

DESCRIPTION OF EMBODIMENTS

Figure 1:
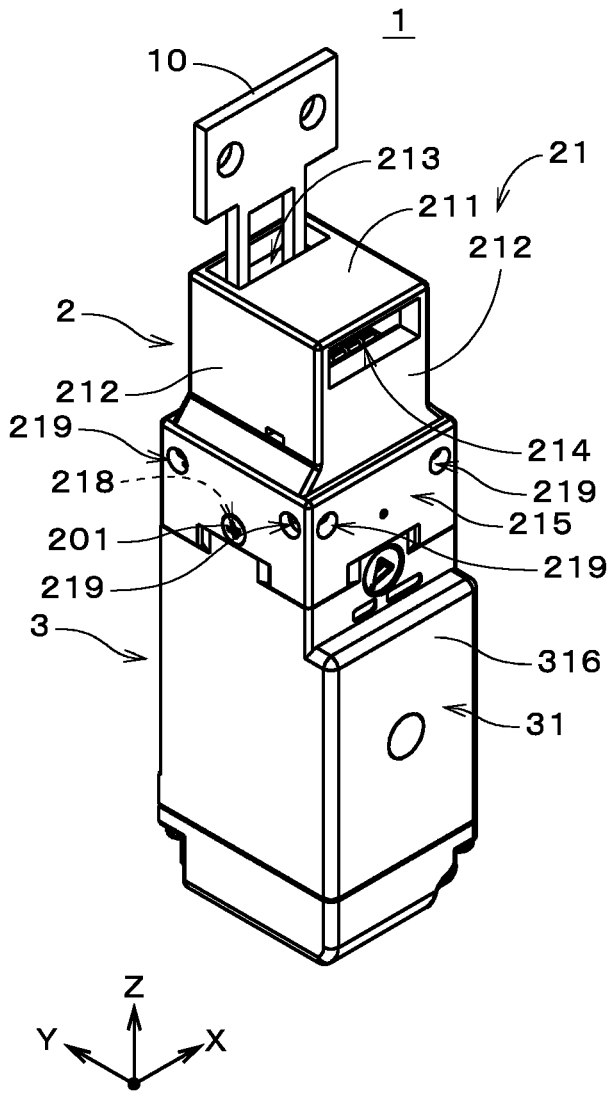
FIG. 1 is a perspective view of a safety switch.
Figure 2:
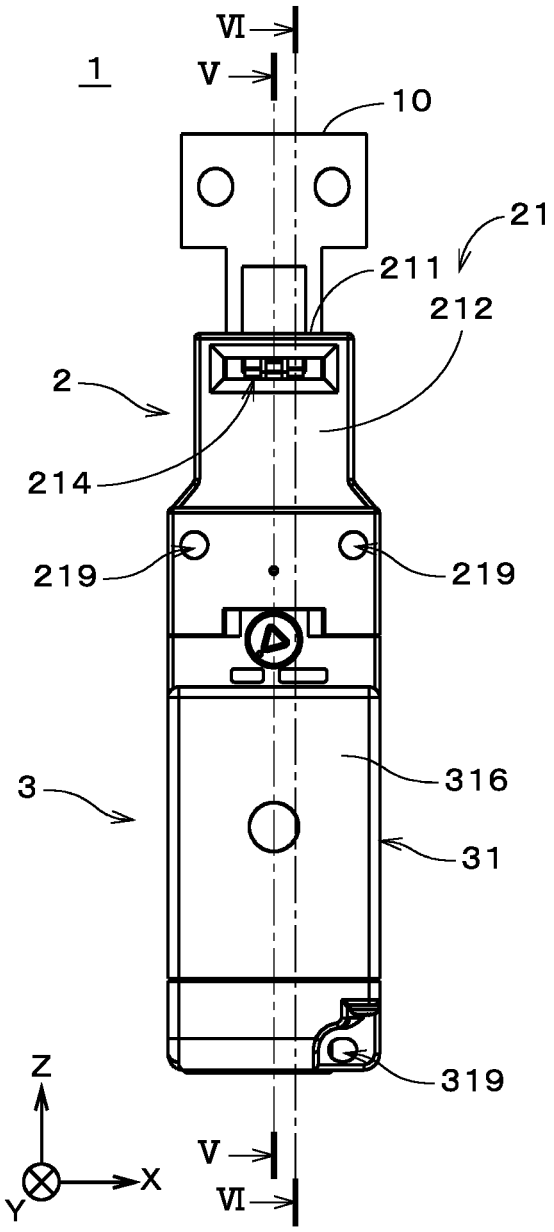
FIG. 2 is a front view of the safety switch.
Figure 3:
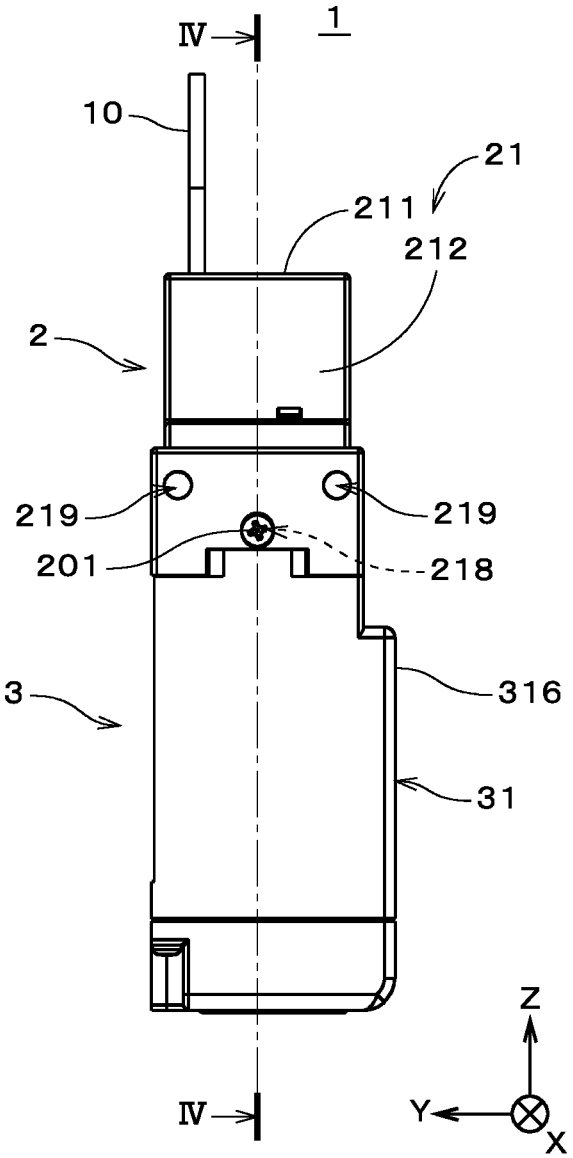
FIG. 3 is a side view of the safety switch.

FIG. 1 is a perspective view of a safety switch 1 according to an embodiment of the present invention. FIG. 2 is a front view of the safety switch 1, and FIG. 3 is a side view of the safety switch 1. In FIGS. 1 to 3, three directions orthogonal to one another are indicated by arrows as X, Y, and Z directions (the same applies to the other drawings). The X, Y, and Z directions are merely illustrative for convenience in description, and the Z direction does not necessarily have to be the direction of gravity.

The safety switch 1 is a switch that is electrically connected to industrial equipment located in a given room. Typically, the safety switch 1 is mounted on a wall surface at the periphery of an entrance to the room. Also, an actuator 10 for the safety switch 1 is mounted on a door located at the entrance. When the entrance door is closed, the actuator 10 is inserted into an opening of the safety switch 1, which enables power supply to the industrial equipment. When the entrance door is opened, the actuator 10 is withdrawn from the opening, which disables power supply to the industrial equipment.

The safety switch 1 includes a head 2 in which the actuator 10 is insertable, and a body 3 with a built-in contact block. The head 2 includes a head case 21. The head case 21 has a bottomless box-like shape and has a top face part 211 on the +Z side and four side face parts 212. The top face part 211 does not necessarily have to be located on the upper side in the direction of gravity. The top face part 211 has an opening 213. Among the four side face parts 212, two side face parts 212 are perpendicular to the X direction, and the remaining two side face parts 212 are perpendicular to the Y direction. One side face part 212 that faces in the −Y direction has an opening 214. The two openings 213 and 214 are open to different directions. The actuator 10 is to be inserted into either of the two openings 213 and 214. Each side face part 212 also has two mounting screw holes 219. On the two side face parts 212 that are perpendicular to the X direction, the positions of the mounting screw holes 219 overlap in the X direction. Similarly, on the two side face parts 212 that are perpendicular to the Y direction, the positions of the mounting screw holes 219 overlap in the Y direction.

Figure 4:
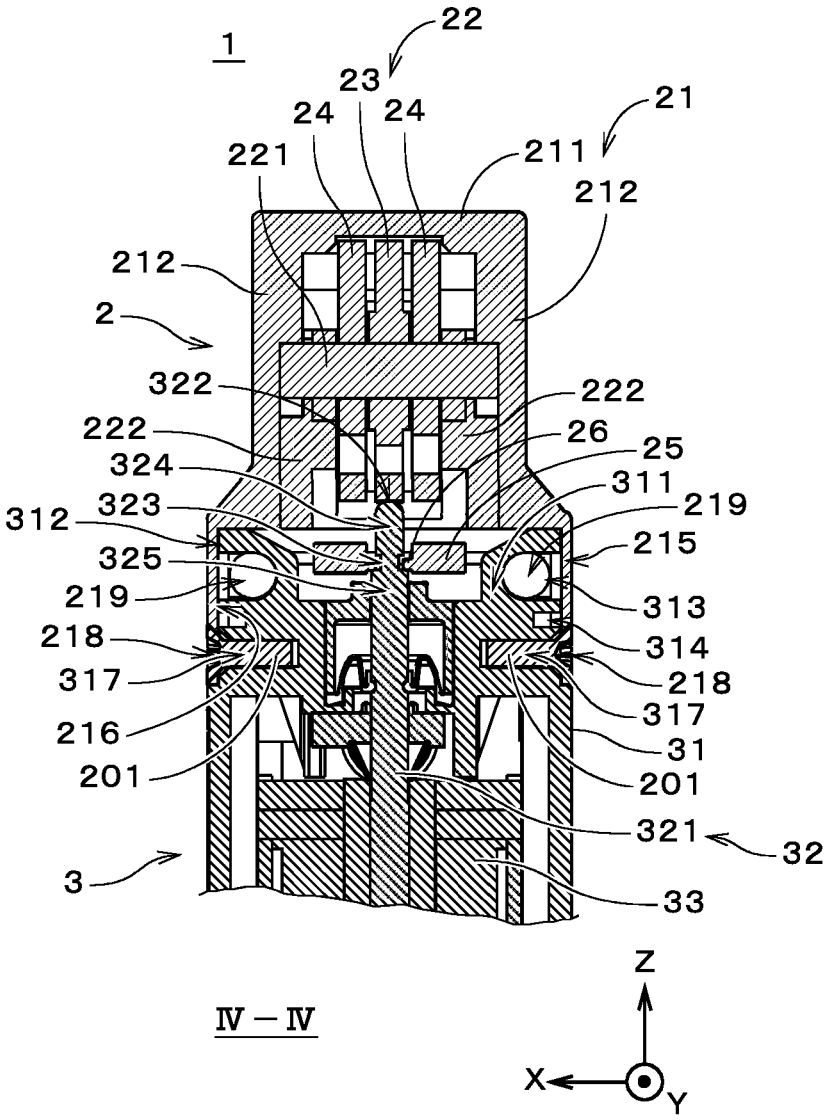
FIG. 4 is a sectional view of the safety switch.
Figure 5:
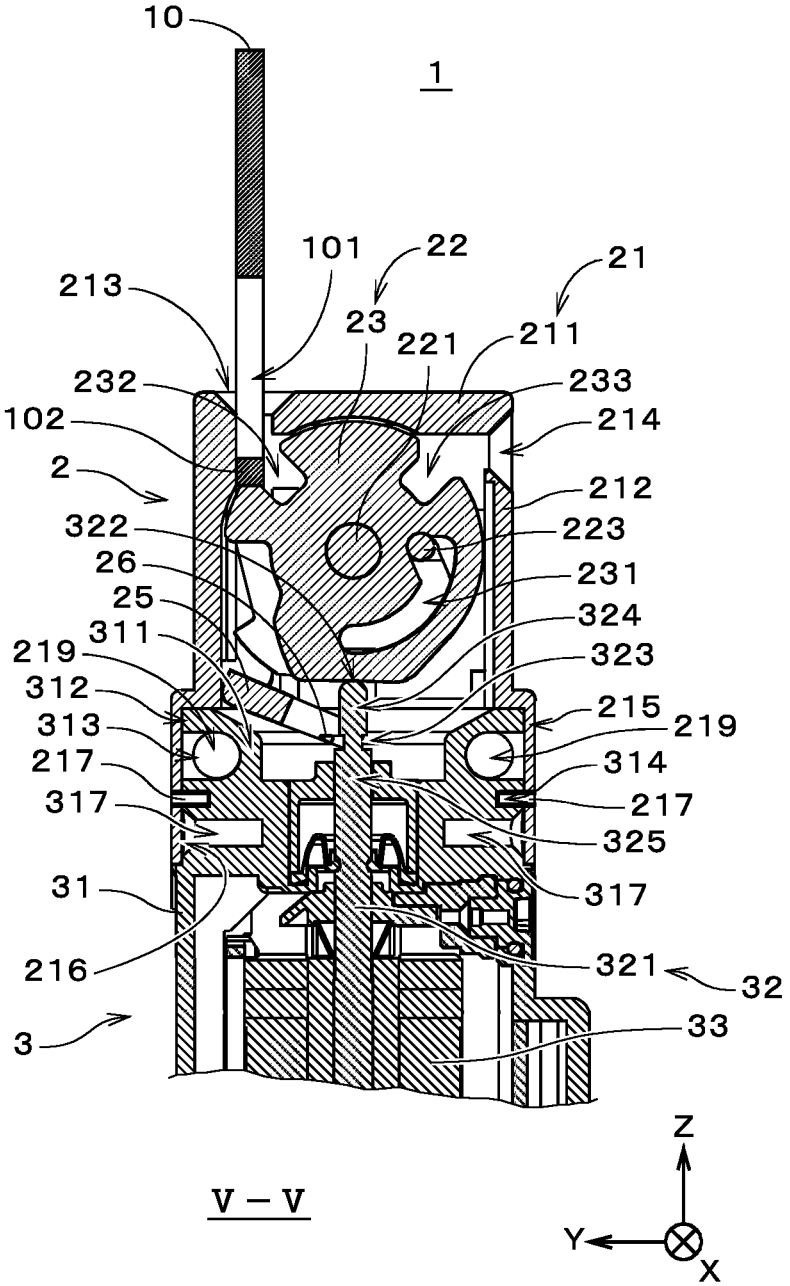
FIG. 5 is a sectional view of the safety switch.
Figure 6:
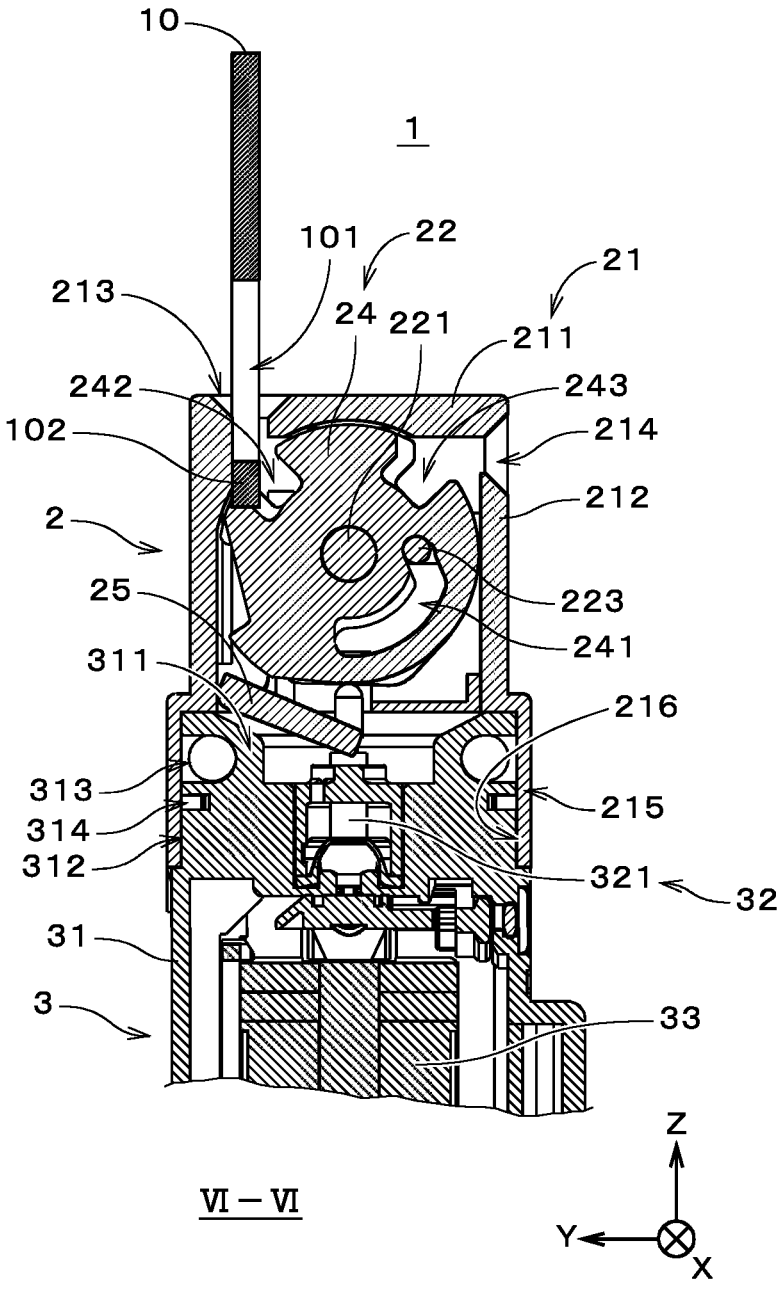
FIG. 6 is a sectional view of the safety switch.

FIG. 4 is a sectional view of the safety switch 1, taken at a position indicated by an arrow IV-IV in FIG. 3. FIG. 5 is a sectional view of the safety switch 1, taken at a position indicated by an arrow V-V in FIG. 2. FIG. 6 is a sectional view of the safety switch 1, taken at a position indicated by an arrow VI-VI in FIG. 2. FIGS. 4 to 6 illustrate the head 2 and a part of the body 3 on the +Z side (part on the side close to the head 2).

As illustrated in FIGS. 4 to 6, the body 3 includes a body case 31, a switch part 32, and an unlocking part 33. The switch part 32 and the unlocking part 33 are assembled on the inside of the body case 31. The switch part 32 includes an operation rod 321 that extends in the Z direction. The operation rod 321 is supported within the body case 31 so as to be movable in the Z direction. The operation rod 321 is biased toward the +Z direction by an elastic member, which is not shown, and a tip end face 322 of the operation rod 321 on the +Z side abuts on the outer peripheral surface of an operation cam 23, which will be described later, as illustrated in FIGS. 4 and 5.

The operation rod 321 has a ring-shaped groove 323. The ring-shaped groove 323 is formed at a position that is farther away from the operation cam 23 than the tip end face 322. In the following description, a part of the operation rod 321 that is located between the tip end face 322 and the ring-shaped groove 323 is referred to as a tip end part 324, and a part of the operation rod 321 that is located in close proximity to the ring-shaped groove 323 on the opposite side to the tip end part 324 (a part on the −Z side of the ring-shaped groove 323) is referred to as an intermediate part 325. The diameter of the tip end part 324 is greater than the diameter of the operation rod 321 measured at the ring-shaped groove 323, and the diameter of the intermediate part 325 is greater than the diameter of the tip end part 324. The end of the operation rod 321 on the −Z side is connected to the contact block, which is not shown. The unlocking part 33 includes a solenoid, for example, and when the solenoid is energized from an external source, moves the operation rod 321 in the −Z direction (from the position illustrated in FIG. 10 to the position illustrated in FIG. 13, which will be described later).

A part 311 of the body case 31 illustrated in FIGS. 4 to 6 on the +Z side (hereinafter, referred to as a "body's upper part 311") has an outer peripheral surface 312 that is generally cylindrical about the operation rod 321. The outer peripheral surface 312 has two ring-shaped grooves 313 and 314 centering on the operation rod 321 and arranged in the Z direction. When viewed in the X direction, the ring-shaped groove 313 on the +Z side overlaps with the mounting screw holes 219 on the two side face parts 212 that are perpendicular to the X direction (see FIGS. 3 and 5). Similarly, when viewed in the Y direction, the ring-shaped groove 313 overlaps with the mounting screw holes 219 on the two side face parts 212 that are perpendicular to the Y direction (see FIGS. 2 and 4). The ring-shaped groove 314 on the −Z side is used for mounting the body 3 and the head 2, as will be described later. As illustrated in FIGS. 4 and 5, the outer peripheral surface 312 of the body's upper part 311 further has four holes 317 that are respectively open to the +X, −X, +Y, and −Y directions. The four holes 317 are formed on the −Z side of the ring-shaped groove 314.

A part 215 of the head case 21 on the −Z side (hereinafter, referred to as a "head case's lower part 215") has an inner peripheral surface 216 that is generally cylindrical about the operation rod 321. The head case's lower part 215 is fitted in the body's upper part 311. That is, the inner peripheral surface 216 of the head case's lower part 215 and the outer peripheral surface 312 of the body's upper part 311 are brought into contact with or close proximity to each other. The diameter of the inner peripheral surface 216 of the head case's lower part 215 is slightly greater than the diameter of the outer peripheral surface 312 of the body's upper part 311. As illustrated in FIG. 5, the head case's lower part 215 is provided with a plurality of (e.g., two) anti-drop pins 217. The anti-drop pins 217 are arranged at equiangular intervals in the circumferential direction about the operation rod 321. The anti-drop pins 217 protrude inward of the inner peripheral surface 216 of the head case's lower part 215 and are located in the ring-shaped groove 314 of the body's upper part 311. With the above-described structure, the head case 21 is supported by the body case 31 while being rotatable relative to the body case 31 about the operation rod 321.

As illustrated in FIG. 4, the two side face parts 212 of the head case's lower part 215 that are perpendicular to the X direction have holes 218. The holes 218 overlap with the holes 317 of the body's upper part 311 that face in the X direction. When the body case 31 is rotated 90 degrees relative to the head case 21, the holes 218 overlap with the other holes 317 (i.e., the holes 317 facing in the Y direction before the rotation). In the safety switch 1, the head case 21 and the body case 31 configure the entire case of the safety switch 1. Depending on the design of the safety switch 1, the case may be configured by a single case member or three or more case members.

In the case of mounting the safety switch 1 illustrated in FIG. 1 on the wall surface, the safety switch 1 is disposed on the wall surface such that the actuator 10 mounted on the door is insertable in either of the openings 213 and 214. At this time, a part of one side face part 212 (hereinafter, referred to as a "mounting side face part 212") of the head case 21 that is included in the head case's lower part 215 is in contact with the wall surface, and in this condition, a fixing screw is inserted into each mounting screw hole 219 of the side face part 212 that opposes the mounting side face part 212. The fixing screws reach the wall surface through the mounting screw holes 219 in the mounting side face part 212 and the ring-shaped groove 313 in the body's upper part 311 and are fastened to the wall surface.

For a preferable mounting operation, one side face part 316 (hereinafter, referred to as a "specific side face part 316") of the body case 31 that faces in the −Y direction in FIG. 2 is disposed in advance on the opposite side to the mounting side face part 212 by rotating the head case 21 relative to the body case 31. Also, a tapping screw 201 is inserted into each hole 218 of the head case 21 and fastened to the inside of the hole 317 of the body case 31 (see FIG. 4) so as to stop the rotation of the head case 21 and the body case 31. Thereafter, the above-described mounting operation is performed to mount the safety switch 1 on the wall surface. In order to more securely mount the safety switch 1 on the wall surface, a mounting screw hole 319 provided in a part of the specific side face part 316 on the −Z side is used. That is, a fixing screw is also inserted into this mounting screw hole 319 and fastened to the wall surface.

As illustrated in FIGS. 4 to 6, the head 2 further includes cams 22 and a locking member 25. The cams 22 and the locking member 25 are housed in the head case 21. The cams 22 include the operation cam 23 and two lock cams 24. The operation cam 23 and the two lock cams 24 are plate cams and formed of, for example, metal. As illustrated in FIG. 4, the operation cam 23 is disposed between the two lock cams 24. The operation cam 23 and the two lock cams 24 are rotatable about a rotational shaft 221 that is parallel to the X direction. Both ends of the rotational shaft 221 are sandwiched between and supported by two cam supporters 222 and portions of the inner face of the head case 21. FIG. 5 illustrates a section of the operation cam 23, and FIG. 6 illustrates a section of one lock cam 24.

The outer peripheral surface of the operation cam 23 illustrated in FIG. 5 is a cam surface over which the tip end face 322 of the operation rod 321 slides. The distance from this outer peripheral surface to the rotational shaft 221 changes with the rotation angle (rotational position) of the operation cam 23. As will be described later, the cams 22 (operation cam 23 and two lock cams 24) rotate about the rotational shaft 221 in accordance with an insertion operation of inserting the actuator 10 into the opening 213 or 214 and a withdrawal operation of withdrawing the actuator 10. As described previously, the operation rod 321 is biased toward the operation cam 23. Thus, the operation rod 321 reciprocates in the Z direction according to the rotation angle of the cams 22.

As illustrated in FIGS. 5 and 6, the operation cam 23 and the two lock cams 24 respectively have guide holes 231 and 241 that extend in the circumferential direction about the rotational shaft 221. A pin 223 that extends in the X direction is inserted into the guide holes 231 and 241 of the operation cam 23 and the two lock cams 24. Both ends of the pin 223 are supported by the two cam supporters 222 so as to be movable in the Y direction. The pin 223 is biased in the +Y direction by springs (not shown) provided in the cam supporters 222. With the pin 223 and the guide holes 231 and 241, the operation cam 23 and the two lock cams 24 become rotatable only when their rotation angles approximately coincide with one another.

Figure 7:
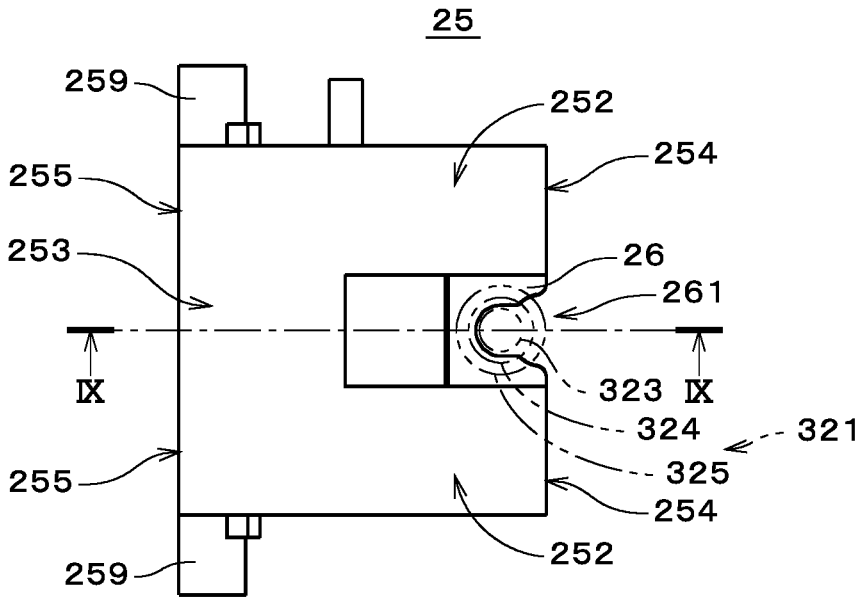
FIG. 7 illustrates a locking member.
Figure 8:
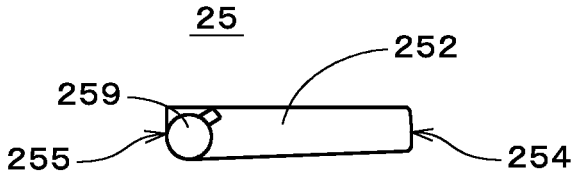
FIG. 8 illustrates the locking member.
Figure 9:
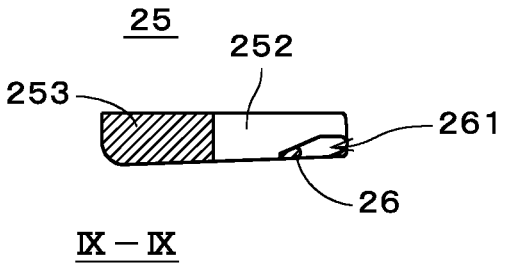
FIG. 9 is a sectional view of the locking member.

FIGS. 7 to 9 illustrate the locking member 25. FIG. 7 is a plan view of the locking member 25, and FIG. 8 illustrates the locking member 25 viewed from the underside of FIG. 7. FIG. 9 illustrates a section of the locking member 25, taken at a position indicated by an arrow IX-IX in FIG. 7. The locking member 25 has a generally U-shaped plate-like external shape. In other words, the locking member 25 includes two locking bodies 252 that extend in the right-left direction in FIG. 7 and one connection 253 that connects the two locking bodies. The two locking bodies 252 are parallel to each other, and the connection 253 is disposed between the two locking bodies 252 and connected to the ends of the locking bodies.

Each locking body 252 is, in principle, a solid plate-like part with no holes or the like. The locking body 252 may have any other shape such as a solid rod-like shape. Both end faces 254 and 255 of the locking body 252 in the right-left direction in FIG. 7 are approximately parallel to each other (see FIG. 8). Each locking body 252 has an axial part 259 on the side face on the side opposite to the connection 253. The axial part 259 is perpendicular to the longitudinal direction of the locking body 252. The two axial parts 259 of the two locking bodies 252 are disposed in line with each other. The two locking bodies 252 have a coupling part 26 therebetween. The coupling part 26 has a plate-like shape thinner than the locking bodies 252 (see FIG. 9) and has a generally U-shaped external shape. That is, the coupling part 26 has a coupling recess 261 that is open toward the right in FIG. 7. The whole of the locking member 25 (the locking bodies 252, the connection 253, the coupling part 26, and the axial parts 259) is formed of, for example, metal as a single member.

As illustrated in FIGS. 4 to 6, when the locking member 25 is assembled in the head case 21, the two axial parts 259 are sandwiched between the two cam supporters 222 and portions of the inner face of the head case 21 in parallel with the rotational shaft 221 of the cams 22. Accordingly, the locking member 25 is supported by the head case 21 so as to be rotatable about the axial parts 259 that are parallel to the rotational shaft 221. Also, the coupling part 26 is coupled directly to the operation rod 321 as illustrated in FIGS. 4 and 5.

Here, the coupling of the coupling part 26 and the operation rod 321 will be described with reference to FIG. 7. In FIG. 7, the dimensions of the tip end part 324, the intermediate part 325, and the ring-shaped groove 323 of the operation rod 321 are indicated by chain double-dashed lines. The width of the coupling recess 261 in the up-down direction in FIG. 7 (which is the width of a part on the side close to the connection 253 and the width measured at the position of the tip end part 324 indicated by the chain double-dashed line) is smaller than the diameters of the tip end part 324 and the intermediate part 325 of the operation rod 321. Also, the above width of the coupling recess 261 is greater than the diameter of the operation rod 321 measured at the ring-shaped groove 323. Thus, the ring-shaped groove 323 and the coupling recess 261 are fitted in and engaged with each other, and the coupling part 26 and the operation rod 321 are coupled to each other. The coupling part 26 is also rotatable along the ring-shaped groove 323. Therefore, when the head case 21 rotates relative to the body case 31, the locking member 25 supported by the head case 21 rotates with the head case 21 about the operation rod 321.

The outer peripheral surface of the operation cam 23 illustrated in FIG. 5 has two recesses 232 and 233. The outer peripheral surface of the lock cam 24 illustrated in FIG. 6 has two recesses 242 and 243. In the state illustrated in FIGS. 5 and 6, the recess 232 of the operation cam 23 and the recess 242 of the lock cam 24 are disposed in close proximity to the opening 213. The recess 233 of the operation cam 23 and the recess 243 of the lock cam 24 are disposed in close proximity to the opening 214.

Figure 10:
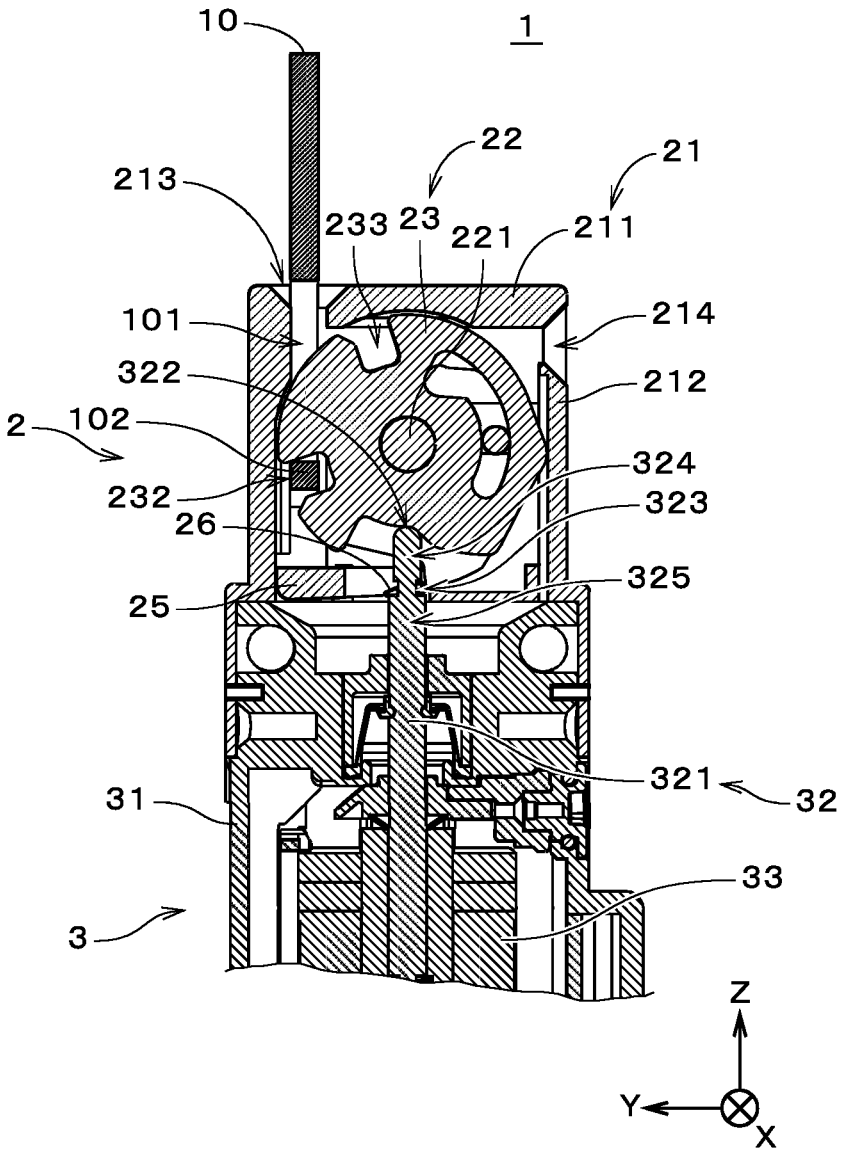
FIG. 10 is a sectional view of the safety switch.

When a tip end part 101 of the actuator 10 is inserted into, for example, the opening 213, a pressure piece 102 of the tip end part 101 that extends in the X direction abuts on the faces of the recesses 232 and 242 of the operation cam 23 and the two lock cams 24 disposed within the head case 21. When the tip end part 101 is further deeply inserted into the opening 213, the pressure piece 102 is engaged with the recesses 232 and 242, and the operation cam 23 and the lock cams 24 rotate counterclockwise in FIGS. 5 and 6 about the rotational shaft 221. Accordingly, as illustrated in FIG. 10, the operation rod 321 of the switch part 32 is disposed at a position closer to the rotational shaft 221 than the position illustrated in FIG. 5, and the connection status of the contact block is switched.

Figure 11:
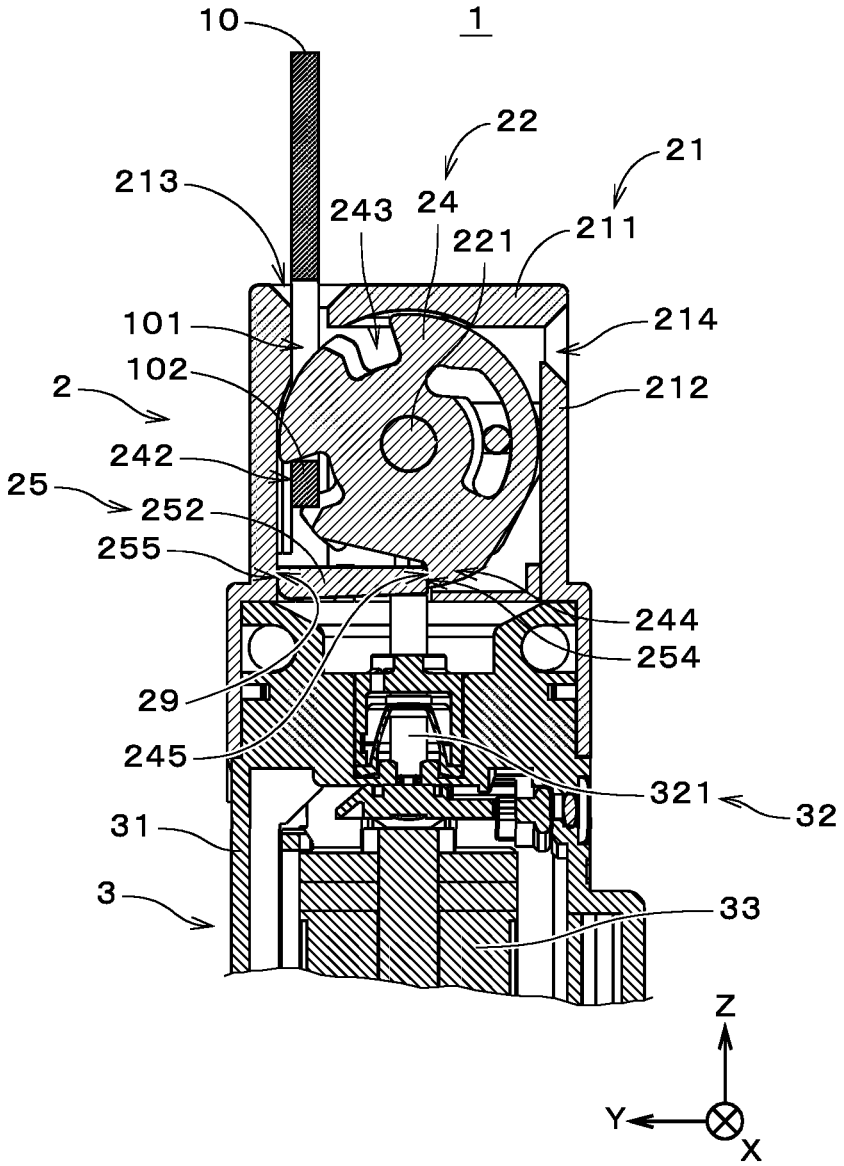
FIG. 11 is a sectional view of the safety switch.

As described above, when the cams 22 have rotated in accordance with the insertion operation of inserting the actuator 10 and the operation rod 321 has moved according to the rotation angle of the cams 22, the switch part 32 detects an insertion state where the actuator 10 is inserted in the opening 213. FIGS. 10 and 11 respectively illustrate the operation cam 23 and one lock cam 24 in the insertion state. In the insertion state, the pressure piece 102 of the tip end part 101 is fitted in the recesses 232 and 242 of the operation cam 23 and the lock cams 24.

At this time, the locking member 25 rotates about the axial parts 259 with movement of the operation rod 321 toward the rotational shaft 221, and the coupling part 26 moves toward the rotational shaft 221. Thereby, the plate-like locking bodies 252 are placed in a posture that is generally parallel to an XY plane as illustrated in FIG. 11. The outer peripheral surface of each lock cam 24 has a protrusion 244, and in the insertion state, faces 245 of the protrusions 244 on the +Y side (hereinafter, referred to as "opposite faces 245") oppose the end faces 254 of the locking bodies 252 on the −Y side with a slight gap therebetween. As a result, the clockwise rotation of the lock cam 24 in FIG. 11 is stopped by the locking member 25, which disables withdrawal of the actuator 10 from the opening 213. That is, in the insertion state, the locking member 25 engages with the protrusions 244 of the lock cams 24 and mechanically locks the operation of withdrawing the actuator 10. In the following description, a state where the actuator 10 is locked by the locking member 25 is referred to as a "locked state."

When the operation of withdrawing the actuator 10 is performed in the locked state, the opposite face 245 of the protrusion 244 of the lock cam 24 illustrated in FIG. 11 directly pushes the end face 254 of the locking body 252 on the −Y side in the +Y direction. Hereinafter, the direction in which the cams 22 push the locking member 25 is referred to as a "pushing direction." The axial parts 259 of the locking member 25 are supported by the head case 21 so as to be slightly movable in the pushing direction (i.e., there is play in the pushing direction). Therefore, the end faces 255 of the locking bodies 252 on the +Y side abut on a part 29 of the inner face of the head case 21 and directly push this part 29 in the pushing direction. At this time, the force acting on the axial parts 259 in the opposite direction to the pushing direction is sufficiently smaller than the force acting on the end faces 255 in the opposite direction to the pushing direction. In the following description, a region where the force in the pushing direction acts on the inner face of the head case 21, i.e., the aforementioned part 29 of the inner face, is referred to as a "pressed region 29."

Figure 12:
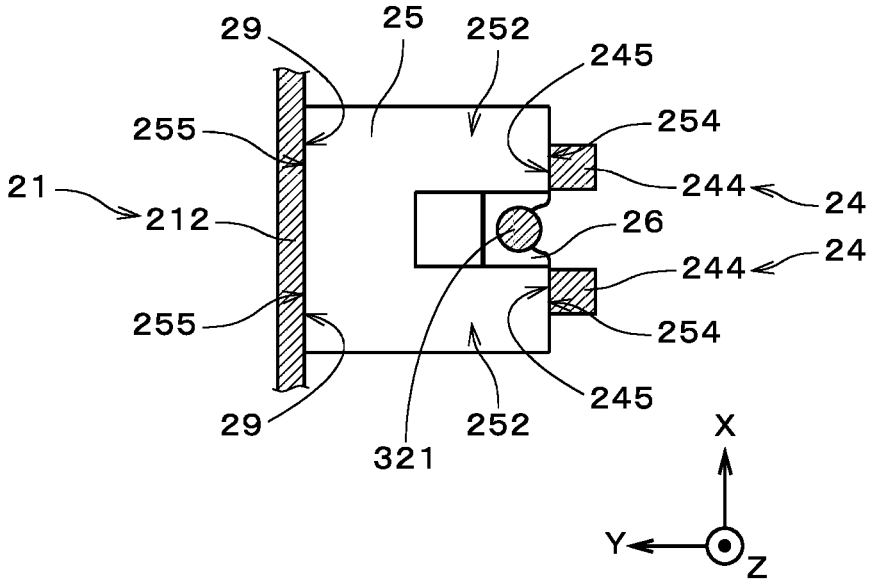
FIG. 12 illustrates the proximity of the locking member.

FIG. 12 illustrates the proximity of the locking member 25 in the locked state. In FIG. 12, the operation rod 321, the head case 21, and the lock cams 24 are illustrated in section in a plane parallel to an XY plane and overlapping with the locking member 25. The axial parts 259 of the locking member 25 are not shown (the same applies to FIGS. 24 and 25, which will be described later). In the safety switch 1, parts of the end faces 254 of the locking bodies 252 that are pushed by the opposite faces 245 of the protrusions 244 overlap partly with the pressed region 29 of the head case 21, when viewed in the pushing direction in which the locking bodies 252 are pushed by the lock cams 24. Therefore, compressive loads in the pushing direction act on the locking bodies 252. Since solid members have high strength against compressive loads, the safety switch 1 can increase the force required for forcedly resetting the locked state with the aforementioned withdrawal operation (hereinafter, this force is referred to as "locking strength").

Also, the opposite faces 245 of the protrusions 244 and the end faces 254 of the locking bodies 252 become almost perpendicular to the pushing direction, and large regions of the end faces 254 are pushed by the opposite faces 245. The end faces 255 of the locking bodies 252 and the pressed region 29 of the head case 21 also become almost perpendicular to the pushing direction, and almost the entire end faces 255 push the inner face of the head case 21. As a result, it is possible to suppress damage to the locking member 25 due to a large force acting locally on the locking member 25 when the operation of withdrawing the actuator 10 is performed in the locked state.

Figure 13:
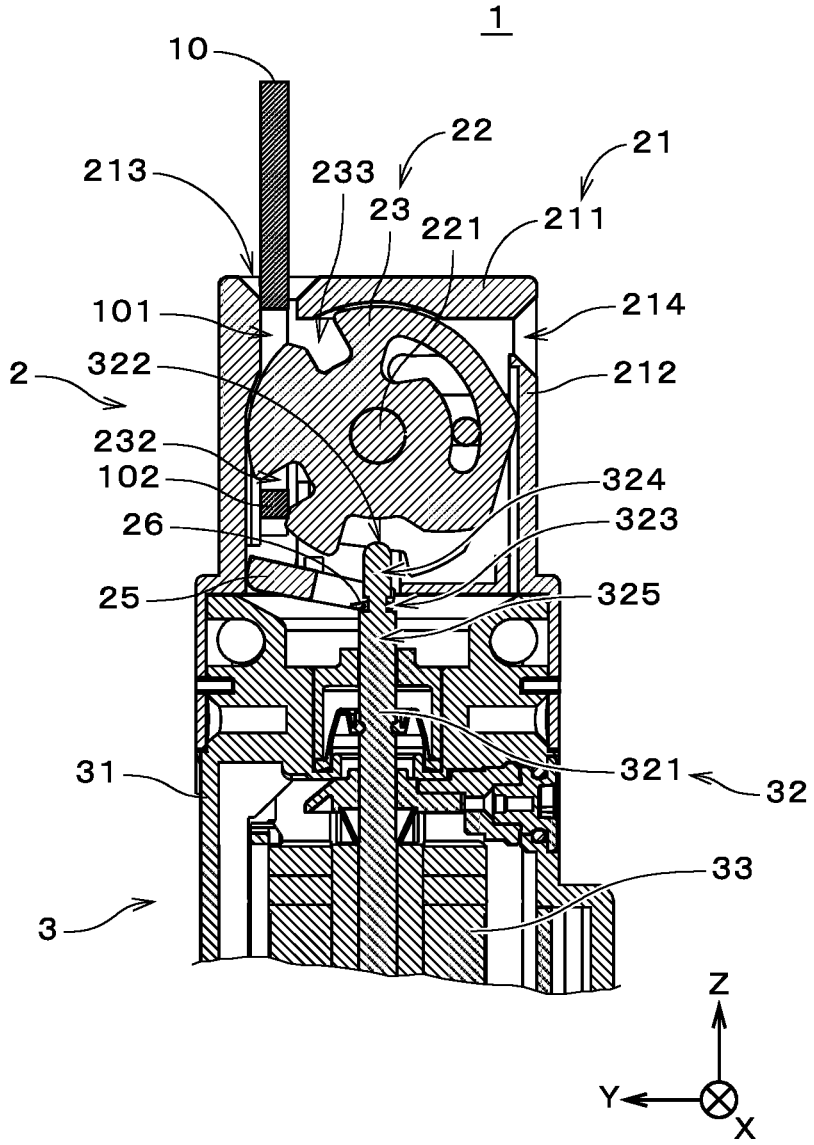
FIG. 13 is a sectional view of the safety switch.
Figure 14:
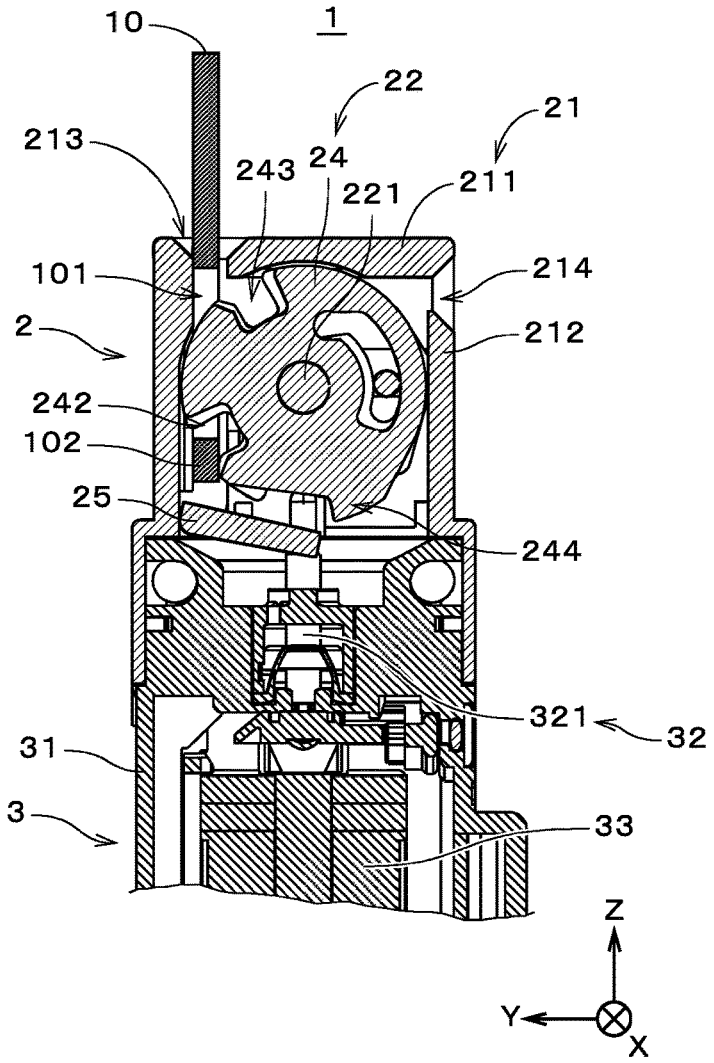
FIG. 14 is a sectional view of the safety switch.

In the case of normally withdrawing the actuator 10 in the state illustrated in FIGS. 10 and 11, the solenoid in the unlocking part 33 is energized. Thereby, as illustrated in FIG. 13, the operation rod 321 moves in the −Z direction, and the tip end face 322 is separated from the outer peripheral surface of the operation cam 23. In this way, the actuator 10 is unlocked as a result of the unlocking part 33 causing the operation rod 321 to move independently of the rotation of the cams 22 (i.e., movement that is not along the outer peripheral surface of the operation cam 23). With the movement of the operation rod 321, the connection status of the contact block is switched. FIGS. 13 and 14 respectively illustrate the operation cam 23 and one lock cam 24 immediately after the locked state is reset.

Thereafter, the operation of withdrawing the actuator 10 is performed. Thereby, the operation cam 23 and the lock cams 24 rotate clockwise in FIGS. 13 and 14 and appear as shown in FIGS. 5 and 6. Similar operations to those described above are also performed when the tip end part 101 of the actuator 10 is inserted into the opening 214. Note that the safety switch 1 may also include a manually operated unlocking part, and this unlocking part may be used to unlock the actuator 10.

Here, a safety switch according to a comparative example is assumed, in which an actuator is locked using an operation rod as a locking member. In the safety switch according to the comparative example, shearing or bending loads act on the operation rod when the operation of withdrawing the actuator is performed in the locked state. As a result, the withdrawal of the actuator with a relatively small force can damage the operation rod and unlock the actuator. Although it is also conceivable to increase the thickness of the aforementioned operation rod in order to increase the strength, in this case the external form of the safety switch will increase.

In contrast, in the safety switch 1 illustrated in FIG. 11, the locking member 25 overlaps with the pressed region 29 of the head case 21, when viewed in the pushing direction in which the cams 22 push the locking member 25. Accordingly, compressive loads in the pushing direction act on the locking member 25. This improves the locking strength of the safety switch 1 as compared with that of the above-described safety switch according to the comparative example in which shearing or bending loads act on the operation rod. Besides, the locking strength can be improved with a simple structure, which makes it easy to downsize the safety switch 1.

In the safety switch 1, the locking member 25 is supported by the head case 21 so as to be rotatable about the axial parts 259, and when the operation of withdrawing the actuator 10 is performed in the locked state, the force acting on the axial parts 259 is smaller than the force acting on the face of the locking member 25 on the side close to the pressed region 29 (in the present example, this face is the end faces 255 and does not include the axial parts 259). Accordingly, it is possible to prevent a large force from the cams 22 from acting on the axial parts 259 and damaging the axial parts 259.

The part of the locking member 25 that is pushed by the cams 22 overlaps with the pressed region 29 of the head case 21, when viewed in the pushing direction. This configuration more reliably improves the locking strength of the safety switch 1. The pressed region 29 of the head case 21 is perpendicular to the pushing direction, and when the operation of withdrawing the actuator 10 is performed in the locked state, the end faces 255 of the locking member 25 that are perpendicular to the pushing direction come in contact with the pressed region 29. As a result, it is possible to prevent excessive stress from occurring locally in the locking member 25 and to improve the strength of the locking member 25.

The locking member 25 includes the coupling part 26 that is coupled to and moves with the operation rod 321. Thus, the locking member 25 can more reliably be brought into engagement with the parts (protrusions 244) of the cams 22, i.e., the actuator 10 can be locked, in the insertion state where the operation rod 321 is located closer to the rotational shaft 221 of the cams 22. Also, the locking member 25 can more reliably be separated from the cams 22, i.e., the actuator 10 can be unlocked, when the unlocking part 33 moves the operation rod 321 away from the cams 22. In this way, the safety switch 1 can make the locked and unlocked states formed by the locking member 25 coincide with the position of the operation rod 321, and can improve the reliability of operations of the locking member 25.

The coupling part 26 is coupled to the operation rod 321 while being rotatable about the operation rod 321. Thus, when the safety switch 1 is not mounted on the mounting surface, the head case 21 can be rotated relative to the body case 31 while the coupling part 26 remains in engagement with the operation rod 321.

Figure 15:
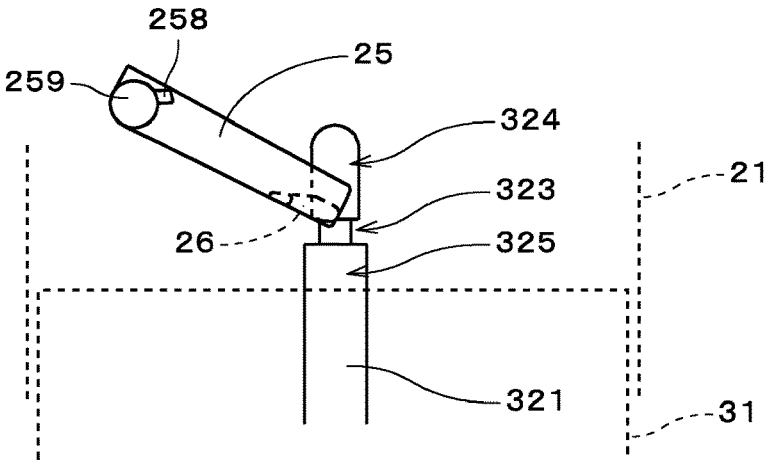
FIG. 15 is a diagram for describing an operation of coupling the locking member and an operation rod.
Figure 16:
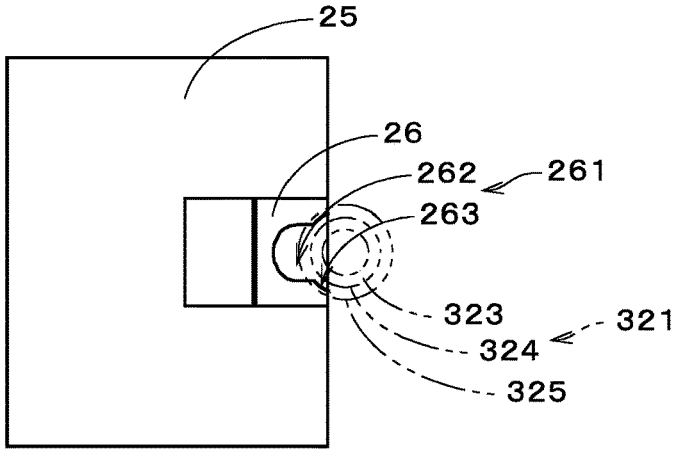
FIG. 16 is a diagram for describing the operation of coupling the locking member and the operation rod.

Here, description is given of the operation of coupling the locking member 25 and the operation rod 321 during assembly of the safety switch 1. FIGS. 15 and 16 are diagrams for describing the operation of coupling the locking member 25 and the operation rod 321. FIG. 15 illustrates the locking member 25 and the operation rod 321 when viewed in a direction perpendicular to the operation rod 321 and along the axial parts 259 of the locking member 25, and the head case 21 and the body case 31 are indicated by broken lines. FIG. 16 illustrates the locking member 25 when viewed from the upper side in FIG. 15. In FIG. 16, for the convenience of illustration, the tip end part 324, the intermediate part 325, and the ring-shaped groove 323 of the operation rod 321 are indicated by chain double-dashed lines, and the axial parts 259 are not shown.

As illustrated in FIG. 16, the coupling recess 261 of the coupling part 26 has a narrow part 262 and a wide part 263. The width of the narrow part 262 in the up-down direction in FIG. 16 is greater than the diameter of the operation rod 321 measured at the ring-shaped groove 323 and smaller than the diameter of the tip end part 324. The width of the wide part 263 in the up-down direction is greater than the diameter of the tip end part 324 and smaller than the diameter of the intermediate part 325.

The operation of coupling the locking member 25 and the operation rod 321 is implemented by bringing the head case 21, in which the cams 22 and the locking member 25 are assembled, and the body case 31, in which the switch part 32 is assembled, close to each other in a straight line along the operation rod 321. At this time, the head case 21 is disposed above the body case 31 in the vertical direction. The locking member 25 is supported in a posture illustrated in FIG. 15 as a result of protrusions 258 on the axial parts 259 abutting on parts of the inner face of the head case 21, and the face of the wide part 263 of the coupling recess 261 and the tip end part 324 of the operation rod 321 come in contact with or close proximity to each other as illustrated in FIG. 16.

When the head case 21 and the body case 31 have approached each other until a part of the coupling part 26 that forms the wide part 263 abuts on the intermediate part 325, this part slides over the upper face of the intermediate part 325, and the narrow part 262 is disposed within the ring-shaped groove 323 while the locking member 25 is rotating about the axial parts 259. This completes the operation of coupling the locking member 25 and the operation rod 321. As described above, in the safety switch 1, the coupling part 26 of the locking member 25 and the ring-shaped groove 323 of the operation rod 321 can be brought into engagement with each other with ease by bringing the head case 21 and the body case 31 close to each other in a straight line along the operation rod 321.

Figure 17:
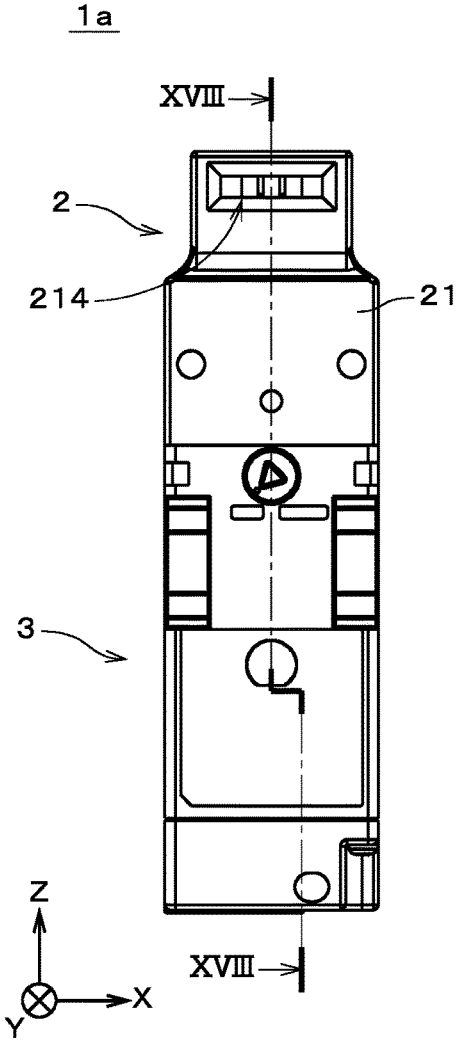
FIG. 17 illustrates another example of the safety switch.
Figure 18:
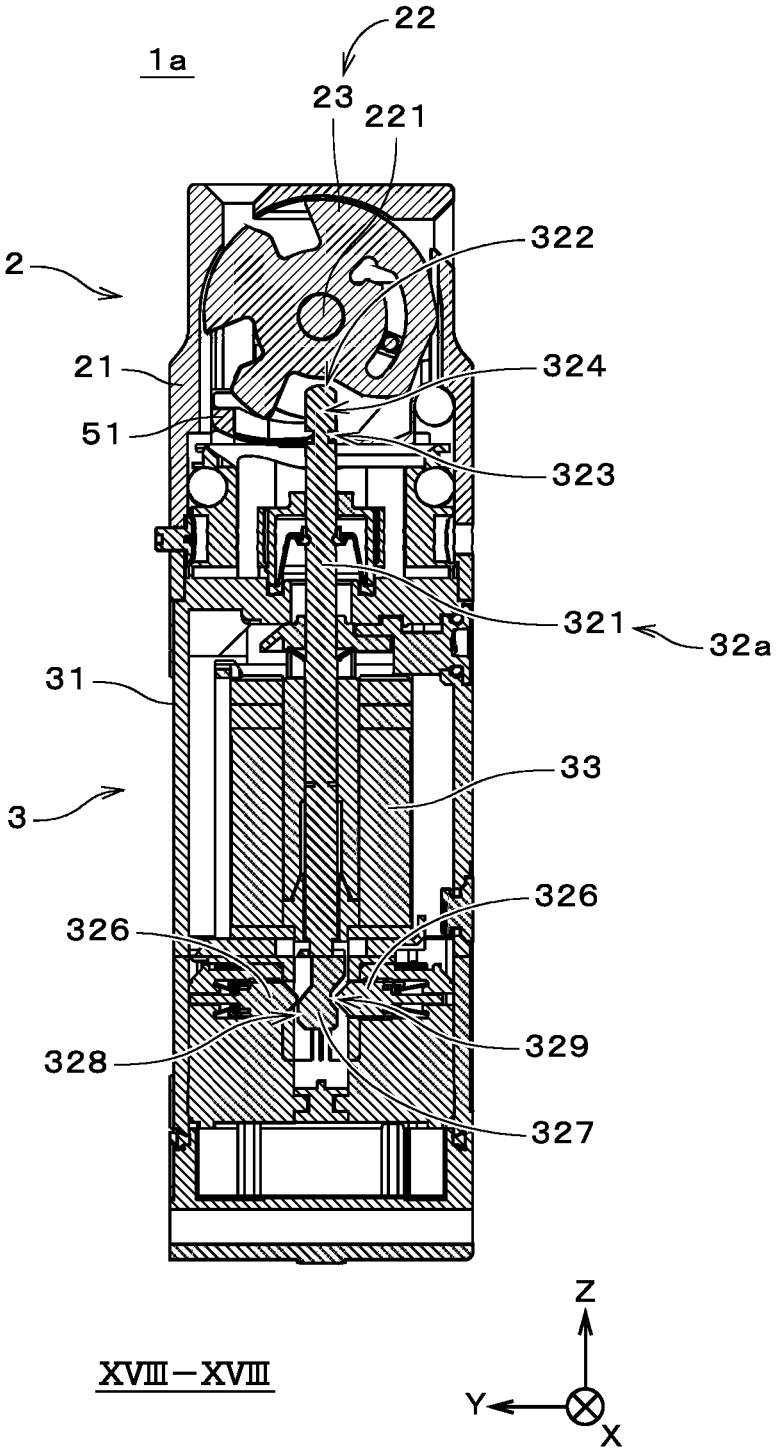
FIG. 18 is a sectional view of the safety switch.

FIGS. 17 and 18 illustrate a safety switch 1*a* according to another example. FIG. 17 is a front view of the safety switch 1*a*, and FIG. 18 is a sectional view of the safety switch 1*a*, taken at a position indicated by an arrow XVIII-XVIII in FIG. 17. The safety switch 1*a* differs from the safety switch 1 in FIG. 1 in the structures of a locking member 51 and a switch part 32*a*. The other configuration is similar to that of the safety switch 1 in FIG. 1, and the same constituent elements are given the same reference signs.

Figure 19:
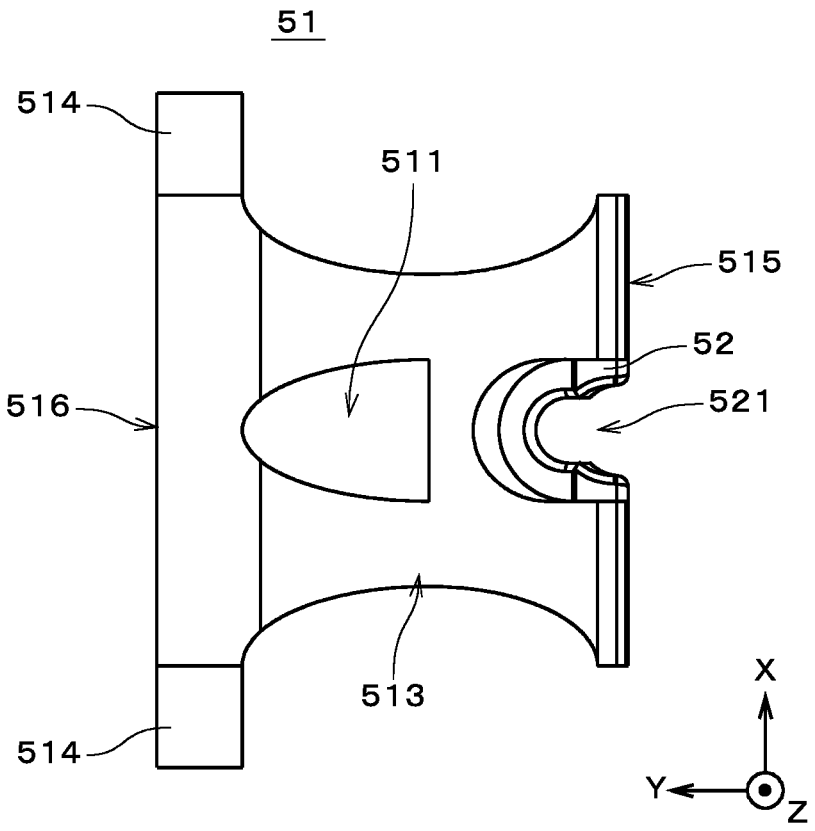
FIG. 19 illustrates a locking member.
Figure 20:
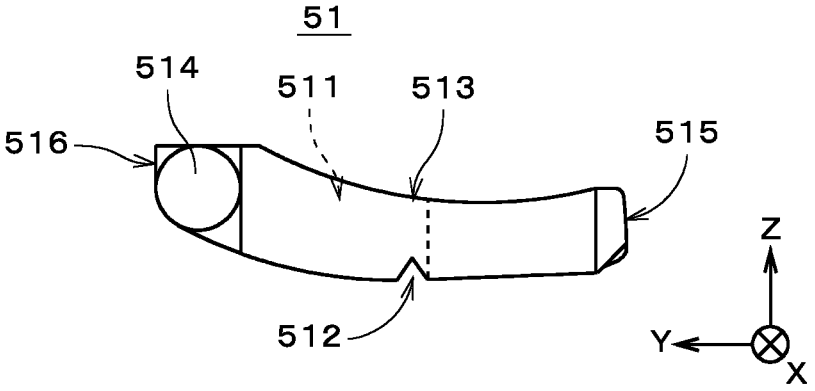
FIG. 20 illustrates the locking member.

FIGS. 19 and 20 illustrate the locking member 51. FIG. 19 is a plan view of the locking member 51, and FIG. 20 is a front view of the locking member 51. The locking member 51 is a generally plate-like member that extends in the X and Y directions, and it is slightly curved so as to be recessed in the +Z direction. The width of the locking member 51 in the X direction is minimum in the proximity of the center in the Y direction and gradually increases toward both ends in the Y direction.

The locking member 51 has a through hole 511. The through hole 511 is located in the center of the locking member 51 in the X direction. The through hole 511 also extends from the proximity of the center of the locking member 51 in the Y direction to the proximity of the end thereof on the +Y side. The width of the through hole 511 in the X direction is maximum in the proximity of the center of the locking member 51 in the Y direction and gradually decreases toward the +Y direction. Thus, a total width of the remaining part of the locking member 51 in the X direction, excluding the through hole 511 and a coupling part 52 described later, is minimum in the proximity of the center in the Y direction. The face of the locking member 51 on the −Z side has a notch 512. The notch 512 is located in close proximity to the center in the Y direction and extends across the width of the locking member 51 in the X direction, excluding the through hole 511. With the above-described structure, the part of the locking member 51 in the proximity of the center in the Y direction forms a weakened part 513 at which the locking member 51 will be broken when excessive compressive loads act on the locking member 51 in a direction along the Y direction. The structure of the weakened part 513 can be appropriately changed, and for example only the notch 512 may be provided while the through hole 511 is omitted. As another alternative, a recess may be provided, instead of the through hole 511.

At the end of the locking member 51 on the +Y side, axial parts 514 are provided on opposite side faces that face in the X direction. The locking member 51 is supported by the head case 21 so as to be rotatable about the axial parts 514. At the end of the locking member 51 on the −Y side, a coupling part 52 is provided in the center in the X direction. The coupling part 52 includes a coupling recess 521 that is engaged with the ring-shaped groove 323 of the operation rod 321, and is directly coupled to the operation rod 321 while being rotatable about the operation rod 321, like the coupling part 26 of the above-described locking member 25.

As illustrated in FIG. 18, the switch part 32*a* includes the operation rod 321, a plurality of switches 326, and an operation end part 327. In the switch part 32*a*, the operation rod 321 is biased in the +Z direction, i.e., toward the cams 22, by an elastic member not shown. The operation end part 327 is provided at the end of the operation rod 321 on the −Z side. The plurality of switches 326 is aligned in the X direction on each of the +Y and −Y sides of the operation end part 327. In FIG. 18, only two switches 326 arranged on the +Y and −Y sides of the operation end part 327 are illustrated. Each switch 326 has a contact therein, and the contact is turned off upon press of a part of the switch 326 (hereinafter referred to as an "opposing part") that opposes the operation end part 327. The operation end part 327 includes a protrusion 328 that opposes the switches 326 on the +Y side in FIG. 18 and a recess 329 that opposes the switches 326 on the −Y side.

Figure 21:
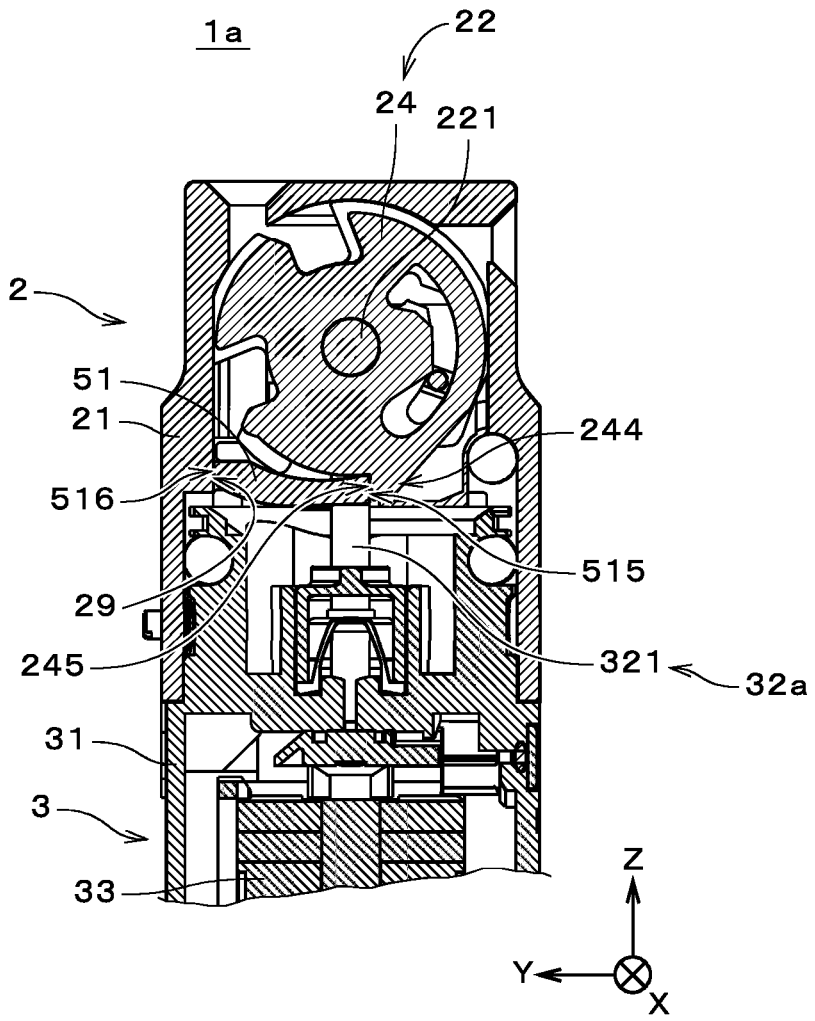
FIG. 21 is a sectional view of the safety switch.

FIG. 21 is a sectional view of the safety switch 1*a*. FIG. 21 illustrates one lock cam 24 in the insertion state and corresponds to FIG. 11. In FIG. 21, the actuator 10 is not shown. In the safety switch 1*a*, the locking member 51 engages with the protrusion 244 of the lock cam 24 in the insertion state and forms a locked state where the actuator 10 is locked by the locking member 51. In the locked state, the opposite face 245 of the protrusion 244 on the +Y side opposes an end face 515 of the locking member 51 on the −Y side. In the switch part 32*a*, the insertion state is detected via movement of the operation rod 321. In the normal insertion state, as illustrated in FIG. 18, the operation rod 321 is retained by the locking member 51 at a position (hereinafter, referred to as a "normal retention position") at which the tip end face 322 of the operation rod 321 is slightly spaced from the operation cam 23. At this time, the contact of the switch 326 on the +Y side in FIG. 18 is turned off as a result of the opposing part of this switch 326 abutting on (being pushed against) the protrusion 328 of the operation end part 327. Also, the opposing part of the switch 326 on the −Y side is disposed within the recess 329 of the operation end part 327. Thus, the contact of this switch 326 is turned on.

When the operation of withdrawing the actuator 10 is performed in the locked state, the opposite face 245 of the lock cam 24 illustrated in FIG. 21 directly pushes the end face 515 of the locking member 51 on the −Y side in the +Y direction (i.e., in the pushing direction). At this time, the axial parts 514 (see FIG. 19) are supported by the head case 21 while there is play in the pushing direction, and an end face 516 of the locking member 51 on the +Y side abuts on the pressed region 29 of the inner face of the head case 21 and directly pushes the pressed region 29 in the pushing direction. In the safety switch 1*a*, the part of the end face 515 of the locking member 51 that is pushed by the opposite face 245 of the protrusion 244 overlaps partly with the pressed region 29 of the head case 21, when viewed in the pushing direction. Accordingly, the safety switch 1*a* can ensure a certain degree of locking strength.

In the case of normally withdrawing the actuator 10, the operation rod 321 moves in the −Z direction upon energization of the solenoid in the unlocking part 33. This causes the locking member 51 illustrated in FIG. 21 to rotate, separates the end face 515 of the locking member 51 on the −Y side from the opposite face 245 of the protrusion 244, and unlocks the actuator 10. Thereafter, the operation of withdrawing the actuator 10 is performed.

If a force that exceeds locking strength acts on the safety switch 1*a* in the insertion state, the weakened part 513 (see FIG. 20) of the locking member 51 will be broken. In the safety switch 1*a*, the material, shape, and the like of the locking member 51 are selected and designed such that the weakened part 513 will be broken before the lock cams 24. In the safety switch 1*a*, the actuator 10 is withdrawn as a result of the break of the locking member 51. At this time, the tip end face 322 of the operation rod 321 illustrated in FIG. 18 is brought into contact with the outer peripheral surface of the operation cam 23, and the operation rod 321 is moved in the −Z direction with rotation of the operation cam 23. Thereby, the switch part 32*a* appears as in the case where the actuator 10 is normally withdrawn.

Figure 22:
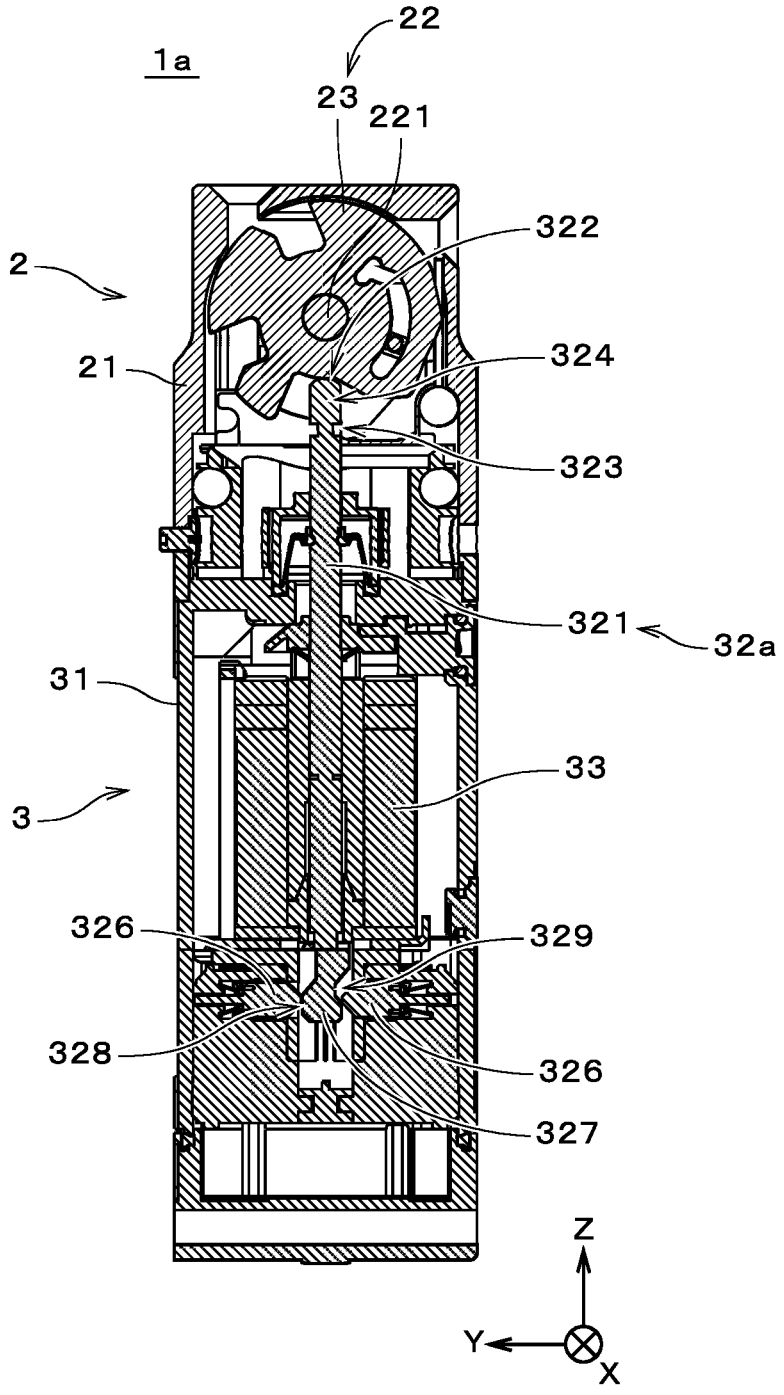
FIG. 22 is a sectional view of the safety switch in which the locking member has been broken.
Figure 23:
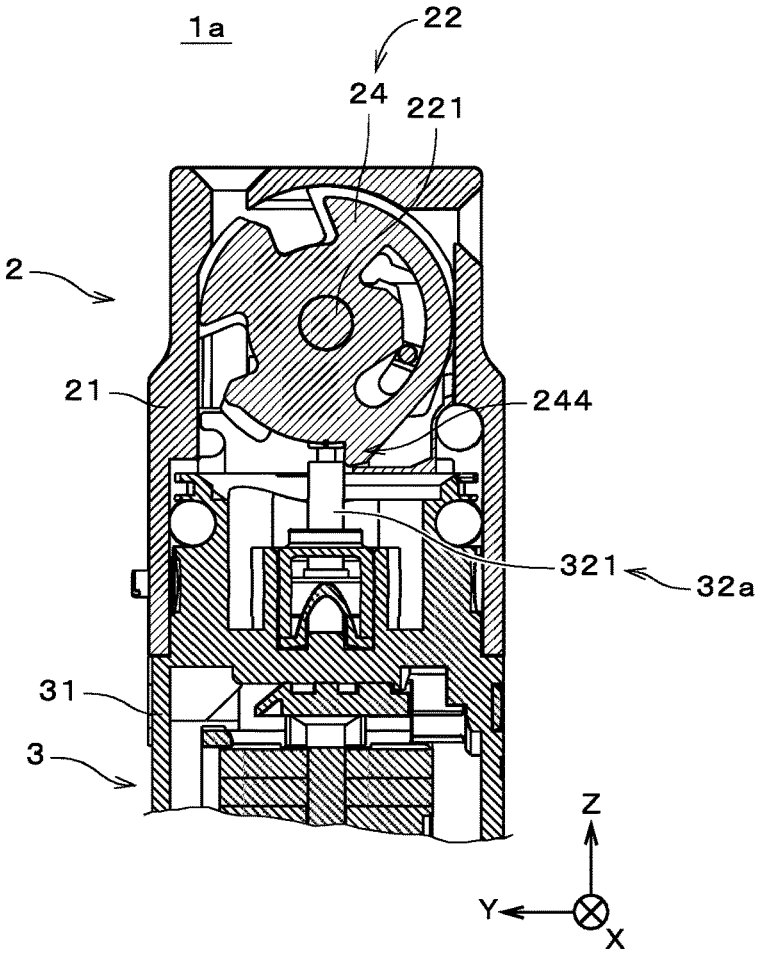
FIG. 23 is a sectional view of the safety switch in which the locking member has been broken.

FIGS. 22 and 23 are sectional views of the safety switch 1*a* in which the locking member 51 has been broken, and correspond respectively to FIGS. 18 and 21. In the case where the insertion state is formed by inserting the actuator 10 again after the break of the weakened part 513, as illustrated in FIG. 23, the locking member 51 is not sandwiched between the protrusions 244 of the lock cams 24 and the inner face of the head case 21, and the operation rod 321 is not retained by the locking member 51. Thus, the tip end face 322 of the operation rod 321 abuts on the outer peripheral surface of the operation cam 23 as illustrated in FIG. 22. That is, the operation rod 321 is disposed at a position closer to the operation cam 23 than the normal retention position illustrated in FIG. 18.

At this time, the contact of the switch 326 on the +Y side in FIG. 22 is turned off as a result of the opposing part of this switch 326 abutting on the protrusion 328 of the operation end part 327 as in FIG. 18. On the other hand, the opposing part of the switch 326 on the −Y side abuts on a part of the recess 329 of the operation end part 327 on the −Z side. Thus, the contact of this switch 326 is turned off, and the switch part 32*a* detects the break of the locking member 51. Note that the configuration of the switch part 32*a* that detects the break of the locking member 51 can be appropriately changed as long as it uses a difference in the position of the operation rod 321 that depends on whether the operation rod 321 is retained by the locking member 51.

As described above, the locking member 51 of the safety switch 1*a* includes the coupling part 52 that is coupled to and moves with the operation rod 321. This makes it possible to make the locked and unlocked states of the locking member 51 coincide with the position of the operation rod 321 and to improve reliability of operations of the locking member 51. In the insertion state, the operation rod 321 is retained by the locking member 51 that engages with parts of the cams 22, at the normal retention position spaced from the cams 22. This prevents an unnecessary force from acting on the tip end part 324 of the operation rod 321 in the insertion state and suppresses damage to the operation rod 321. The locking member 51 further includes the weakened part 513. In the case where the weakened part 513 is broken by the operation of withdrawing the actuator 10 in the locked state, in the next insertion state, the operation rod 321 is disposed at a position closer to the cams 22 than the normal retention position. This makes it easy to for the switch part 32*a* to detect the break of the weakened part 513.

In the safety switch 1*a*, the part of the locking member 51 that is pushed by the lock cams 24 overlaps with the pressed region 29 of the head case 21, when viewed in the pushing direction in which the cams 22 push the locking member 51. This improves the locking strength of the safety switch 1*a*.

The safety switches 1 and 1*a* described above can be modified in various ways.

Figure 24:
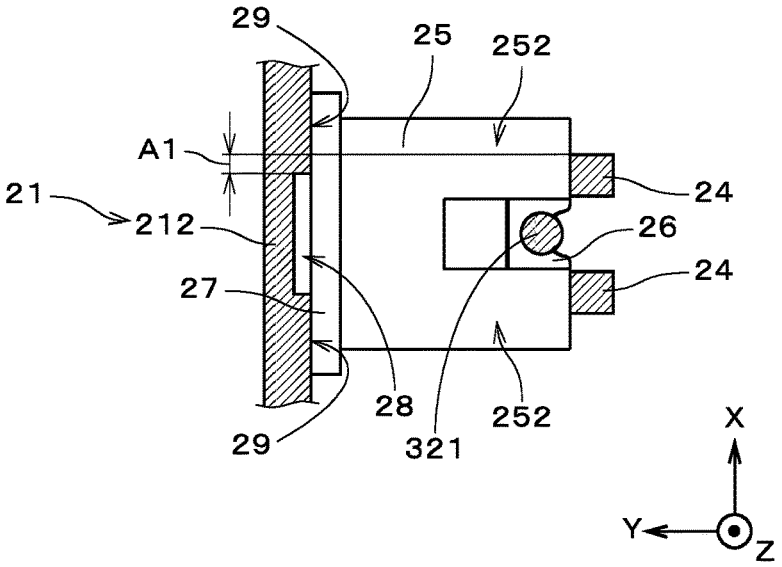
FIG. 24 illustrates the proximity of a locking member according to another example.

As illustrated in FIG. 24, an auxiliary member 27 may be provided between the locking member 25 and the head case 21, and the locking member 25 may indirectly push a part of the inner face of the head case 21 via the auxiliary member 27 in the pushing direction. In the example in FIG. 24, the inner face of the head case 21 has a recess 28, and a part of the pressed region 29 of the inner face around this recess 28 overlaps with the locking member 25 when viewed in the pushing direction (+Y direction). Accordingly, compressive loads in the pushing direction act on the locking member 25, and the locking strength of the safety switch 1 is improved. As described above, in the safety switch 1, it is desirable for the locking member 25 to overlap at least partly with the pressed region 29 when viewed in the pushing direction.

In the example in FIG. 12, the entire part of the locking member 25 that is pushed by the lock cams 24 overlaps with the pressed region 29 of the head case 21 in the pushing direction. In the example in FIG. 24, a part of the part of the locking member 25 that is pushed by the lock cams 24 overlaps with the pressed region 29 of the head case 21 in the pushing direction (see a range A1 in FIG. 24). In this way, if the part of the locking member 25 that is pushed by the lock cams 24 overlaps at least partly with the pressed region 29 when viewed in the pushing direction, the locking strength can be improved more reliably.

Figure 25:
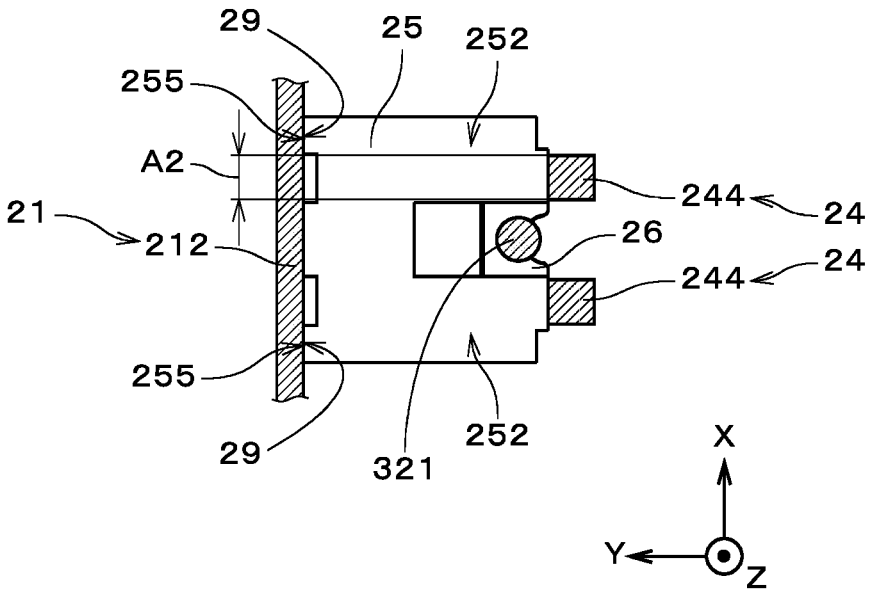
FIG. 25 illustrates the proximity of a locking member according to another example.

On the other hand, depending on the design of the locking member 25, the part of the locking member 25 that is pushed by the lock cams 24 does not necessarily have to overlap with the pressed region 29 in the pushing direction, as illustrated in FIG. 25 (see a range A2 in FIG. 25). The locking member 25 in FIG. 25 includes recesses having a small depth in the pushing direction on the end face 255. Even in this case, the locking strength of the safety switch 1 can be improved by forming the locking member 25 into such a shape as to ensure a certain degree of strength.

Figure 26:
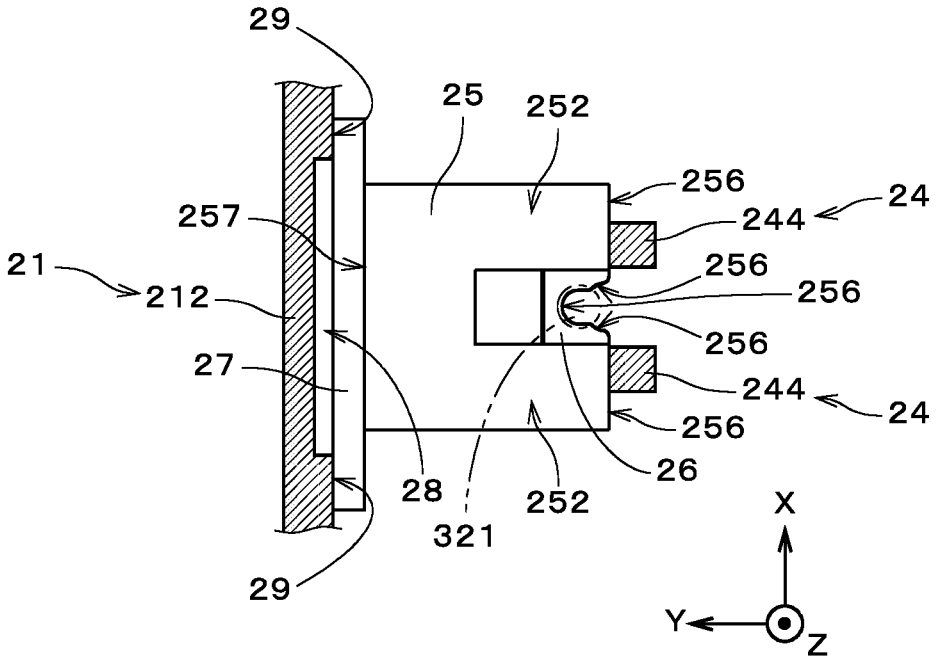
FIG. 26 illustrates the proximity of a locking member according to another example.

In the case where the locking member 25 indirectly pushes a part of the head case 21 (pressed region 29) via the auxiliary member 27 as illustrated in FIG. 26, a recess 28 having a width greater than the width of the locking member 25 in the X direction may be formed in the inner face of the head case 21. In the example in FIG. 26, the auxiliary member 27 has a certain degree of strength. In the safety switch 1, the locking strength of the safety switch 1 can be improved if, in the locked state, a face 256 of the locking member 25 on the side close to parts of the cams 22 (protrusions 244) overlaps with a face 257 of the locking member 25 on the side close to the pressed region 29 when viewed in the pushing direction. In any of the cases in FIGS. 12, 24, and 25, the face of the locking member 25 on the side close to parts of the cams 22 (protrusions 244) overlaps with the face of the locking member 25 on the side close to the pressed region 29 when viewed in the pushing direction. In FIG. 25, the face of the locking member 25 on the side close to the pressed region 29 includes the surfaces of the recesses formed in the end face 255. The same applies to the face of the locking member 25 on the side close to the protrusions 244.

Figure 27:
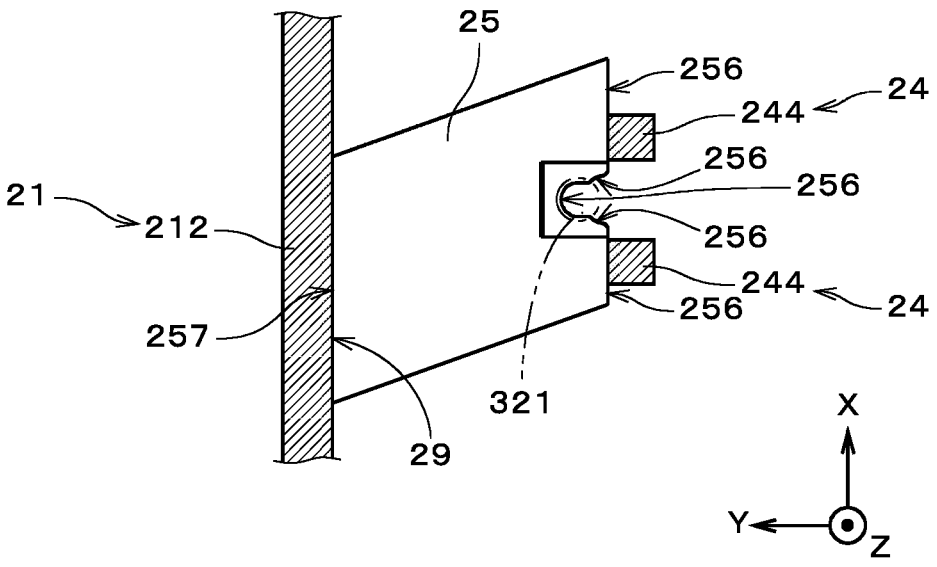
FIG. 27 illustrates the proximity of a locking member according to another example.

Moreover, as illustrated in FIG. 27, the shape of the locking member 25 may be changed such that the face 256 of the locking member 25 on the side close to the protrusions 244 and the face 257 of the locking member 25 on the side close to the pressed region 29 are displaced in the X direction. In the safety switch 1, in order to more reliably improve the locking strength, the face 256 of the locking member 25 on the side close to the protrusions 244 preferably overlaps at least partly with the face 257 of the locking member 25 on the side close to the pressed region 29 when viewed in the pushing direction. The variations described with reference to FIGS. 24 to 27 are also applicable in the same manner to the safety switch 1*a*.

The safety switch 1 may employ a locking member 25 that is not coupled to the operation rod 321 (the same applies to the safety switch 1*a*). In this safety switch 1, for example, the locking member 25 is biased toward the outer peripheral surfaces of the cams 22 by a bias part such as a spring. Thereby, in the insertion state where the actuator 10 is inserted, the locking member 25 is engaged with parts of the cams 22, and the actuator 10 is locked. Also, a member that engages with the locking member 25 is provided separately from the operation rod 321, and the engagement of the locking member 25 with the cams 22 is reset if the unlocking part moves that member.

The axial parts serving as a rotation axis of the locking member 25 or 51 may be provided in the inner face of the head case 21. In this case, for example, a groove or the like that is engageable with the axial parts is provided in the side face of the locking member 25 or 51. Even in such a case where the axial parts are provided in the head case 21, it is desirable that there is play in the pushing direction between the axial parts and the groove. By so doing, when the operation of withdrawing the actuator 10 is performed in the locked state, the force acting on the axial parts in the pushing direction is made smaller than the force acting on the face of the locking member 25 or 51 on the side close to the pressed region 29, and damage to the axial parts is prevented.

The lock cams 24 may be omitted from the cams 22. In this case, in the insertion state where the actuator 10 is inserted, the actuator 10 is locked by bringing the locking member 25 or 51 into engagement with a part of the operation cam 23. Alternatively, the operation cam 23 and the lock cams 24 may be separated from one another in a direction along the rotational shaft 221. In this case, a locking member 25 or 51 that is not coupled to the operation rod 321 is used (e.g., locking member 25 that is biased toward the outer peripheral surfaces of the lock cams 24 by a bias part).

The technique for improving the reliability of operations of the locking member 25 or 51 by providing the coupling part 26 or 52 coupled to the operation rod 321 in the locking member 25 or 51 may be employed in various safety switches. The structure of the coupling part 26 or 52 may be appropriately changed, and for example the operation rod 321 may have a ring-shaped protrusion, instead of the ring-shaped groove 323, and the coupling part 26 or 52 may have a groove that is engaged with the ring-shaped protrusion. In this case as well, the coupling part 26 or 52 can be coupled to the operation rod 321 while being rotatable about the operation rod 321.

The configurations of the above-described preferred embodiments and variations may be appropriately combined as long as there are no mutual inconsistencies.

While the invention has been shown and described in detail, the foregoing description is in all aspects illustrative and not restrictive. It is therefore to be understood that numerous modifications and variations can be devised without departing from the scope of the invention.

REFERENCE SIGNS LIST

1, 1*a* Safety switch
10 Actuator
21 Head case
22 Cam
25, 51 Locking member
26, 52 Coupling part
29 Pressed region
31 Body case
32, 32*a* Switch part
33 Unlocking part
102 Pressure piece
213, 214 Opening
221 Rotational shaft
244 Protrusion
254, 255 End face (of locking body)
259, 514 Axial part
261, 521 Coupling recess
321 Operation rod
322 Tip end face (of operation rod)
323 Ring-shaped groove
513 Weakened part
515, 516 End face (of locking member)

What is claimed is:

1. A safety switch comprising:

a case having an opening in which an actuator is insertable;

a cam disposed in said case and that rotates about a rotational shaft upon engagement with a part of said actuator in accordance with an insertion operation of inserting said actuator into said opening and a withdrawal operation of withdrawing said actuator;

a switch part that includes a rod and detects an insertion state where said actuator is inserted in said opening, the rod having a tip end face that slides over an outer peripheral surface of said cam, the rod reciprocating according to a rotation angle of said cam;

a locking member that locks said actuator upon engagement with a part of said cam in said insertion state; and an unlocking part that unlocks said actuator locked by said locking member, wherein, in a case where said withdrawal operation of withdrawing said actuator is performed in a locked state where said actuator is locked, said cam pushes said locking member in one direction, and said locking member pushes a part of said case either directly or indirectly in said one direction.

2. The safety switch according to claim 1, wherein in said locked state, a face of said locking member on a side close to said part of said cam overlaps at least partly with a face of said locking member on a side close to said part of said case, when viewed in said one direction.

3. The safety switch according to claim 1, wherein said part of said case is perpendicular to said one direction, and a face of said locking member that is perpendicular to said one direction comes in contact with said part of said case when said withdrawal operation is performed in said locked state.

4. The safety switch according to claim 1, wherein said locking member is supported by said case to be rotatable about an axial part that is parallel to said rotational shaft, and when said withdrawal operation is performed in said locked state, a force acting on said axial part is smaller than a force acting on a face of said locking member on a side close to said part of said case.

5. The safety switch according to claim 1, wherein said locking member includes a coupling part that is coupled to and moves with said rod, and said unlocking part unlocks said actuator upon movement of said rod that is independent of rotation of said cam.

6. A safety switch comprising:

a case having an opening in which an actuator is insertable;

a cam disposed in said case and that rotates about a rotational shaft upon engagement with a part of said actuator in accordance with an insertion operation of inserting said actuator into said opening and a withdrawal operation of withdrawing said actuator;

a switch part that includes a rod and detects an insertion state where said actuator is inserted in said opening, the rod having a tip end face that slides over an outer peripheral surface of said cam, the rod reciprocating according to a rotation angle of said cam;

a locking member that locks said actuator upon engagement with a part of said cam in said insertion state; and an unlocking part that unlocks said actuator locked by said locking member, wherein said locking member includes a coupling part that is coupled to and moves with said rod, and said unlocking part unlocks said actuator upon movement of said rod that is independent of rotation of said cam.

7. The safety switch according to claim 5, wherein said switch part biases said rod toward said cam, and in said insertion state, said locking member that is engaged with said part of said cam retains said rod at a predetermined position spaced from said cam.

8. The safety switch according to claim 7, wherein said locking member includes a weakened part, and in a case where said weakened part is broken by said withdrawal operation of withdrawing said actuator in a locked state where said actuator is locked, at a next time when said insertion state is formed, said rod is disposed at a position closer to said cam than said predetermined position, and said switch part detects the break of said weakened part.

9. The safety switch according to claim 5, wherein said case includes:

a head case that houses said cam and said locking member; and a body case in which said switch part is assembled, said coupling part is coupled to said rod while being rotatable about said rod, and when said safety switch is not mounted on a mounting face, said head case is rotatable relative to said body case about said rod.

10. The safety switch according to claim 9, wherein said rod has:

a tip end face that slides over an outer peripheral surface of said cam; and a ring-shaped groove provided at a position that is farther away from said cam than said tip end face, said locking member is supported by said head case to be rotatable about an axial part that is parallel to said rotational shaft, and said coupling part of said locking member has a recess that is engaged with said ring-shaped groove.

11. The safety switch according to claim 6, wherein said switch part biases said rod toward said cam, and in said insertion state, said locking member that is engaged with said part of said cam retains said rod at a predetermined position spaced from said cam.

12. The safety switch according to claim 11, wherein said locking member includes a weakened part, and in a case where said weakened part is broken by said withdrawal operation of withdrawing said actuator in a locked state where said actuator is locked, at a next time when said insertion state is formed, said rod is disposed at a position closer to said cam than said predetermined position, and said switch part detects the break of said weakened part.

13. The safety switch according to claim 6, wherein said case includes:

a head case that houses said cam and said locking member; and a body case in which said switch part is assembled, said coupling part is coupled to said rod while being rotatable about said rod, and when said safety switch is not mounted on a mounting face, said head case is rotatable relative to said body case about said rod.

14. The safety switch according to claim 13, wherein said rod has:

a tip end face that slides over an outer peripheral surface of said cam; and a ring-shaped groove provided at a position that is farther away from said cam than said tip end face, said locking member is supported by said head case to be rotatable about an axial part that is parallel to said rotational shaft, and said coupling part of said locking member has a recess that is engaged with said ring-shaped groove.

* * * * *